US006938801B1

(12) United States Patent
Reddy et al.

(10) Patent No.: US 6,938,801 B1
(45) Date of Patent: Sep. 6, 2005

(54) TEMPERATURE CONTROLLED DISPENSING DEVICE

(75) Inventors: Balakrishna Reddy, Ridgefield, CT (US); J. Antonio Gutierrez, Kent, CT (US)

(73) Assignee: Nestec S.A., Vevey (CH)

( * ) Notice: Subject to any disclaimer, the term of this patent is extended or adjusted under 35 U.S.C. 154(b) by 202 days.

(21) Appl. No.: 10/392,963

(22) Filed: Mar. 21, 2003

(51) Int. Cl.[7] ..... B65D 37/00

(52) U.S. Cl. ..... 222/214; 222/146.1; 222/132; 222/135; 222/529

(58) Field of Search ..... 222/214, 105, 222/146.1, 132, 54, 135, 61, 320, 529

(56) References Cited

U.S. PATENT DOCUMENTS

| | | | | |
|---|---|---|---|---|
| 3,173,579 | A | 3/1965 | Curie et al. | 222/105 |
| 3,212,681 | A | 10/1965 | Weikert | 222/183 |
| 3,297,206 | A | 1/1967 | Scholle | 222/105 |
| 3,435,990 | A | 4/1969 | Pike, Jr. | 222/1 |
| 3,520,451 | A | 7/1970 | Ashizawa | 222/148 |
| 4,094,446 | A | 6/1978 | Brutsman | 222/146 HE |
| 4,141,474 | A | 2/1979 | Nilson | 222/493 |
| 4,544,085 | A | 10/1985 | Frazer | 222/146.4 |
| 4,651,898 | A | 3/1987 | Bell | 222/129 |
| 4,717,047 | A | 1/1988 | van Overbruggen et al. | 222/207 |
| 4,796,788 | A | 1/1989 | Bond | 222/94 |
| 4,913,713 | A | 4/1990 | Bender et al. | 62/3.61 |
| 4,941,597 | A | 7/1990 | Lopez et al. | 222/146.5 |
| 5,000,351 | A | 3/1991 | Rudick | 222/105 |
| 5,040,700 | A | 8/1991 | Compton | 222/146.5 |
| 5,102,015 | A | 4/1992 | Barnard et al. | 222/135 |
| 5,114,045 | A | 5/1992 | Herpe | 222/105 |
| 5,142,610 | A | 8/1992 | Augustine et al. | 392/442 |
| 5,249,706 | A | 10/1993 | Szabo | 222/20 |
| 5,301,601 | A | 4/1994 | Cretors | 99/323.5 |
| 5,349,825 | A | 9/1994 | Duke et al. | 62/69 |
| 5,353,963 | A | 10/1994 | Gorski et al. | 222/129.1 |
| 5,366,308 | A | 11/1994 | Crispino | 401/1 |
| 5,673,817 | A | 10/1997 | Mullen et al. | |
| 5,803,317 | A | 9/1998 | Wheeler | 222/214 |
| 5,833,120 | A | 11/1998 | Evans, Sr. et al. | |
| 5,938,078 | A | 8/1999 | Dorsey et al. | 222/105 |
| 6,003,733 | A | 12/1999 | Wheeler | 222/146.5 |
| 6,016,935 | A | 1/2000 | Huegerich et al. | 222/146.1 |
| 6,056,157 | A | 5/2000 | Gehl et al. | 222/94 |
| 6,089,406 | A | 7/2000 | Feldner | 222/103 |
| 6,095,372 | A | 8/2000 | Dorsey et al. | |
| 6,142,340 | A * | 11/2000 | Watanabe et al. | 222/214 |
| 6,223,944 | B1 | 5/2001 | Gehl et al. | 222/94 |
| 6,378,730 | B1 | 4/2002 | Reddy et al. | 222/83 |
| 6,419,121 | B1 | 7/2002 | Gutierrez et al. | 222/146.5 |
| 6,488,179 | B1 | 12/2002 | Vujicic et al. | 222/132 |
| 6,561,383 | B1 | 5/2003 | Reddy et al. | |

(Continued)

*Primary Examiner*—Phillippe Derakshani
(74) *Attorney, Agent, or Firm*—Bell, Boyd & Lloyd LLC

(57) ABSTRACT

A flowable food dispenser for dispensing a flowable food product. The dispenser includes a housing with first and second bays, and a plurality of cassettes that are removably receivable within the bays. Each cassette is configured for receiving a pouch containing the flowable food. First and second thermal exchange units are associated with the first and second bays, respectively, in heat-exchanging association with the cassettes received therein. A temperature-controlled system is connected with the thermal exchange units for controlling them independently to independently heat or cool the cassettes in the bays and the food product that is disposed therein. A least one dispensing mechanism is associated with the first and second bays to selectively dispense the food from the pouches that are in the cassettes.

35 Claims, 14 Drawing Sheets

U.S. PATENT DOCUMENTS 6,568,565 B1 5/2003 Schroeder et al.
6,708,741 B1 3/2004 Berry et al.
6,726,061 B2 4/2004 Good
6,761,285 B2 7/2004 Bertone

* cited by examiner

TEMPERATURE CONTROLLED DISPENSING DEVICE

FIELD OF THE INVENTION

The invention relates to a dispensing device and method for dispensing flowable materials from packages, such as a pouch. More particularly, the invention relates to a compartmentalized dispensing device and method for more accurately, uniformly and rapidly heating or cooling a food product and maintaining the desired temperature thereof and for dispensing the food product at a desired controlled temperature from the package.

BACKGROUND OF THE INVENTION

Heated or refrigerated dispensers for delivering liquid or semi-liquid food products are commonly used in foodservice restaurants, catering, convenience stores and other commercial or public food establishments. The known dispensers are usually adapted for receiving food bags in a housing and for delivering the food by using pumps and/or gravity forces to a dispensing area.

Food products, such as cheese sauces, usually requires to be served at warm temperature to adapt to culinary habits and/or to improve the digestion of fat. Other food products are adapted to be stored and dispensed cold such as salsa, ketchup or condiment sauces. Other foods are adapted to be dispensed at refrigerated temperatures such as UHT cream, yogurt, acidified milk based food or pudding. These food products may be easily subjected to bacterial spoilage when opened, whereby heating or cooling permits to keep the food in safer bacteriological conditions. The products usually need to be stored in aseptically hermetic flexible packages such as pouches, which are opened at the time the product is dispensed and therefore become sensitive to airborne pathogens. The pouches are usually of relatively large size, in general of several kilograms, thus requiring a relatively long time before obtaining a controlled hot/cool temperature acceptable for serving.

A fully warm/cool food package may not be rapidly available when the demand for food exceeds the warming/cooling operation time for the new package. There is also a risk of bacterial contamination or spoilage when the package is opened before the product reaches a sufficiently safe temperature level, i.e., about 60° C. in the case of hot product or below 4–6° C. for refrigerated products.

For instance, the American NSF standards require that potential hazardous food products having a pH level of 4.6 or less to be rethermalized, i.e., heated from refrigerated or ambient state to an elevated temperature of not less than 140° F., within four hours. For example, by using existing commercial equipment, the average heat-up time for large size pouches is of more than 3 hours, most often more than 5 hours and sometimes more than 10 hours, before the temperature in the center part of the pouch can be raised from ambient to an acceptably warm temperature of 60° C. In order to meet with these regulations, prior solutions consisted in pre-warming the bag in a hot water bath or in microwave oven, then transferring the preheated bag to the dispensing unit where the bag remains temperature controlled.

Similarly, there are food products that are preferably served slightly below ambient, such as cold sauce, salsa, ketchup, condiments and the like, so that the shelf life of the product in the dispensing unit can be prolonged significantly. Especially in hot seasons and non air-conditioned rooms, it is advisable to keep these type products at a temperature below 18° C., and preferably below 15° C. or lower.

U.S. Pat. No. 5,803,317 relates to a heated dispensing apparatus for dispensing products at elevated temperature which allows packaging of the product in a container, such as a flexible bag, with a discharge tube extending therefrom. The dispenser includes a receptacle with an outlet opening in the lower portion thereof and a pump adjacent to the outlet opening. A heater is provided for heating the food bag in a large heat-conductive receptacle and the discharge tube passing through the pump and maintaining both the bag and the tube at a desired elevated temperature. The receptacle is permanently mounted on the dispenser frame and accommodates the reception of a bulky flexible package with a fitment protruding on one side of the package.

Several known dispensers include U.S. Pat. No. 6,003,733, which relates to an apparatus for the dispensing of heated viscous food product using convection means, and U.S. Pat. No. 6,016,935, which relates to a viscous food dispensing and heating/cooling assembly which is adapted to receive large food reservoirs of the "bag-in-box" type. U.S. Pat. Nos. 6,056,157 and 6,223,944 relate to a dispensing device for a flowable substance comprising a housing comprising walls to define a compartment, a heating unit for maintaining the compartment at a predetermined temperature, a valve for selectively controlling flow of the material from the package.

U.S. Pat. No. 6,488,179 relates to a disposable aseptic cassette dispenser with a control center for controlled dispensing and heating of flowable and semi-flowable materials. A comprising a plurality of non-flexible aseptic cassettes are mounted on a base of the dispenser. A dispensing means is also provided for dispensing flowable or semi-flowable material. Each of the cassette contains one or more heating elements.

German company Herman Roelofsen GmbH manufactures food dispensing units comprising a relatively wide box-shaped aluminum container adapted to receive a flexible food bag. The bag is loosely housed within the container and a bar inserted in two slots of the container hangs up the bag to avoid collapsing of the bag within the container. The container fits within a heating metal compartment of the unit which is heated by flexible heating devices. Due to heat loss in the transitions and air gaps from the heaters to the food, the dispensing unit has poor heating performance on large size bags with an heat-up time of more than 10 hours from ambient state for cheese sauce bags. Microwave preheating of the bag is required before the bag can be installed in the dispensing unit.

Thus, there is a need in the art for improved dispensing systems, which are easy to load and use, and which preferably occupy minimal lateral footprint space.

SUMMARY OF THE INVENTION

The present invention relates to a flowable food dispenser that dispenses a flowable food product. A preferred embodiment of the dispenser has a housing with first and second bays. A plurality of cassettes is removably receivable within the bays, and each cassette is configured to receive a pouch containing the food product. First and second thermal exchange units are associated with the first and second bays respectively, and heat exchanging association with the cassettes received therein. A temperature-controlled system is connected with the thermal exchange units for controlling them independently to independently heat or cool the cassettes in the bays and the food product therein. At least one dispensing mechanism is associated with the first and second bays for selectively dispensing the food from the pouches.

Preferably, the bays have a plurality of sides. The first and second thermal exchange devices extend on the two largest of the sides, which are disposed opposite each other, thus heating or cooling the corresponding opposite sides of the cassettes and pouches therein. Another bay side is a connecting side that connects the opposite sides. Preferably, the opposite sides have two perpendicular dimensions, each of which is at least twice as long as the space in between the opposite sides. Also, preferably the opposite sides are disposed substantially upright.

The preferred thermal exchange device, in addition to extending on the opposite sides of the bay, extends on a connecting side of the bay to connect the portions of the thermal exchange device of the opposite sides. As a result, in the preferred embodiment, each of the thermal exchange devices has a U-shaped cross section about the respective bay. Additionally, the preferred thermal exchange devices have electric heating elements extending along the opposite sides, and each thermal exchange device also has a connecting portion extending on the connecting side of the bay for electrically connecting the heating elements. This connecting portion may or may not have heating elements itself, and is preferably provided such that the electric current can be supplied to a single portion of the thermal exchange device and heats both heating elements on the opposite sides of the bay.

The preferred bays of internal walls that are associable with the cassettes received therein to substantially extensively contact the walls of the respective cassette for conductively transferring heat between the thermal exchange device and the cassette. A third thermal exchange unit is preferably configured to circulate a fluid for heating or cooling the dispensing system, as well as at least one of the bays. The third thermal exchange unit preferably heats the bays on one or more sides other than the opposite sides that are heated by the electric heating elements. The fluid can be air, and third thermal exchange device can include a blower. The blower and the housing of the dispenser are preferably configured for directing the air to the dispensing system, and also about the bays, and potentially through the inside of the cassette as well. The air can be circulated around the bays by an access that extends through and preferably normal to the opposite sides. Also, the cassettes can comprise one or more openings that are configured for allowing the air to be circulated through the interior of the cassettes. Preferably input and output openings are provided.

The temperature sensing member, such as a thermistor, can be associated with at least one of the bays and configured for sensing the temperature of the pouch that is within the cassette received in that bay. Preferably, the cassette has a temperature sensing opening to receive the temperature sensing member therethrough to place the temperature sensing member in contact with the pouch. The temperature control system of the dispenser can be associated with the temperature sensing member to upgrade the thermal exchange devices depending on the sensed temperature.

The bays of the preferred embodiment are disposed side-by-side, preferably with the opposing sides of adjacent bays adjacent to each other. Temperature limit units can be disposed between the bays and associated with the thermal exchange devices that are imbedded between the bays to sense the temperature of the thermal exchange devices. When a temperature beyond a predetermined limit is sensed, the thermal exchange device can be caused to remain within this limit, such as by independently deactivating the thermal exchange devices that exceed the limit. The temperature limit device units can comprise plates that are removably receivable between the bays in association with the thermal exchange units, preferably a thermistor as well as another temperature sensitive element can be mounted to the plate.

The preferred dispensing mechanisms include a volumetric dispense, such as peristaltic pumps, that are disposed adjacent, and preferably below, pairs of bays. Each pump can be associated with one of the bays, preferably not the other bays, for receiving discharge tubes from the pouches that are received in the cassettes in said bays. Each of the peristaltic pumps preferably has a rotor and a stator. The stator has a pumping position relative to the rotor for compressing the discharge tubes therebetween and peristaltically pumping the food product from the discharge tube upon rotation of the rotor. The stators of the pumps are each movable to a loading position, in which the stators are spaced from their respective rotors sufficiently to load and remove the discharge tubes therefrom. The loading positions can overlap with each other, such that only one of the stators can occupy its loading positions at any one time, which can help minimize the footprint of the dispenser and economize on the space required for the pumps.

The loading positions can be displaced diagonally from the pumping position of the stators with respect to the horizontal. One of the loading positions, for example, can be displaced from the pumping position at a displacement angle of between 10 and 80 degrees in respect to the horizontal, or with respect to the access extending through the opposed heated sides of the adjacent bays. The preferred stator is each defined a curved compression race that is configured for receiving and compressing the discharge tube against the rotating rotor. The race has an input end and an output end, with the rotor being operated for pumping the food product from the input end to the output end. In the loading end or pumping positions, a line extending to the input and output ends of the stators disposed diagonally with respect to the vertical, or with respect to a longitudinal access of a side extending between the opposed heated sides, at an angle that is preferably less than the displacement angle. The positioning of the stators in one or both positions can also be selected to minimize the width of the pump and also the dispenser as a whole.

In the preferred embodiment, the cassettes are interchangeable between the bays, and the pump is disposed for pumping food from a dispensing bay, and not from a preheating or precooling bay. For that, the bays can be identically sized and shaped to be able to receive any one of the cassettes. The cassettes within the preheating or precooling bays can be transferred to the pumping bays to dispense the product through the pumps.

A dispensing guide is preferably used to aim the exit openings of the discharge tubes to direct the food product to locations at an adjustable distance from each other. For example, the dispensing guide can aim the discharge tubes to dispense the food products to a single location or to different locations. A plurality of dispensing controls activatable by the users can be provided to selectively activate the dispensing mechanism to dispense the food from the discharge tubes. In one mode, the food can be dispensed independently from each of the dispensing systems, and in another mode the food can be dispensed jointly from both dispensing mechanisms to increase the flow and amount of an individual product stored. A dispensing guide can be configured for automatically switching the controls and dispensing mechanism between two modes. In one mode, the controls activate the dispensing mechanisms independently, and in another mode the controls activate the dispensing mechanisms jointly, such as by the depression of a single button or activation of a single control. The mode can be automatically selected depending on the present configuration of the dispensing guide.

DETAILED DESCRIPTION OF THE PREFERRED EMBODIMENTS

Figure 1:
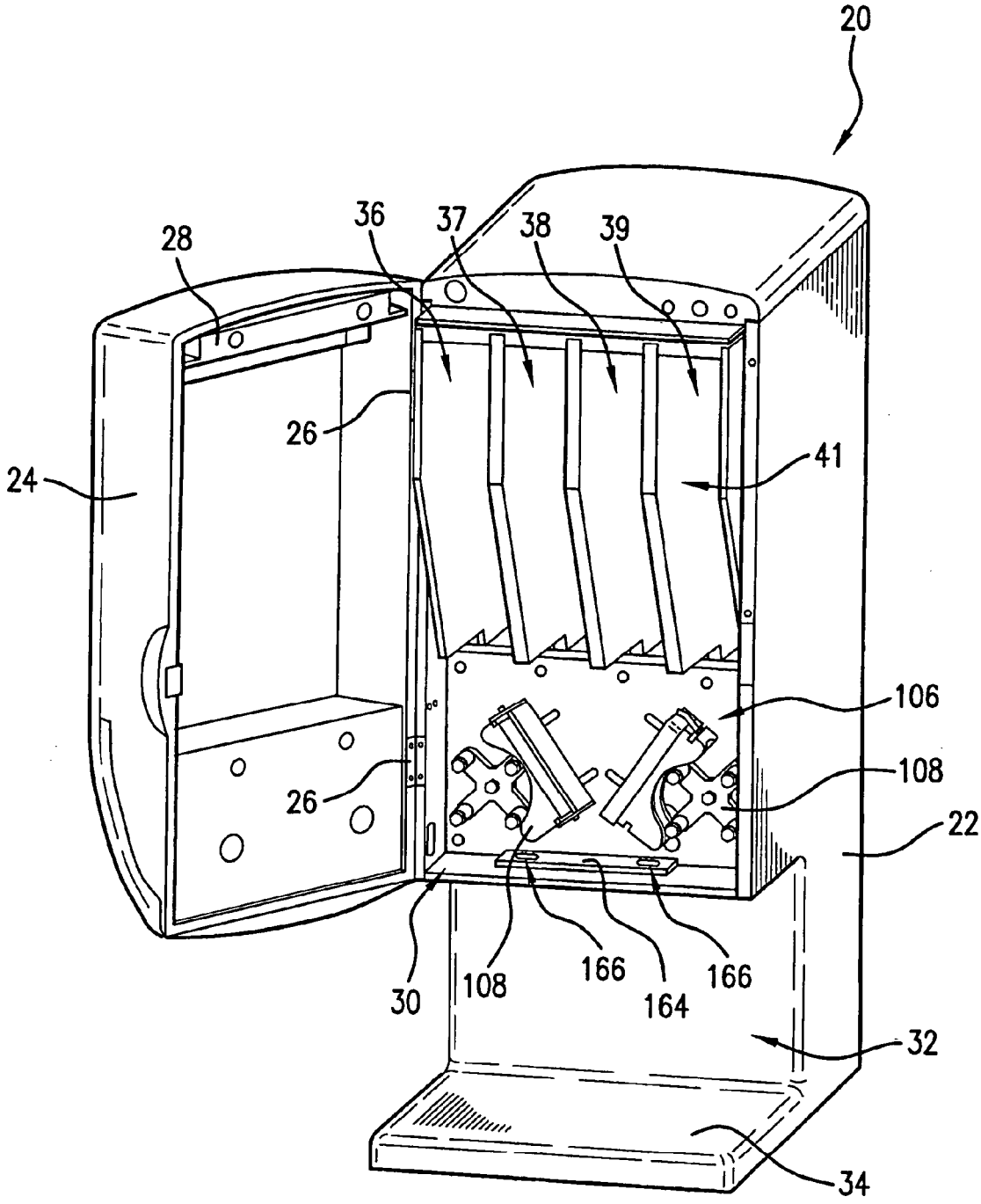
FIG. 1 is a perspective view of a preferred embodiment of a heated-food dispenser constructed according to the invention.

Referring to FIG. 1, a preferred embodiment of a dispenser 20 includes a housing 22 having an interior cavity 30 in which internal components of the dispenser are housed. A front panel 24 is open in the drawing, revealing interior cavity 30 of the housing 22. The front panel is preferably hinged at hinges 26 for pivoting open and closed, although other opening arrangements can be used. The front panel 24 may include an insulation 28 to help maintain the desired temperature within the cavity 30. The housing 22 is preferably also insulated, and all insulation is selected to beneficially reduce or heating or frigorific losses of the dispenser 20.

The housing 22 also preferably has a front dispensing area 32 for positioning a food container or other recipient to receive the food product from the device 20. At the bottom of the housing is a base 34 dimensioned for stably supporting the dispenser 20 and the food product therein.

Figure 2:
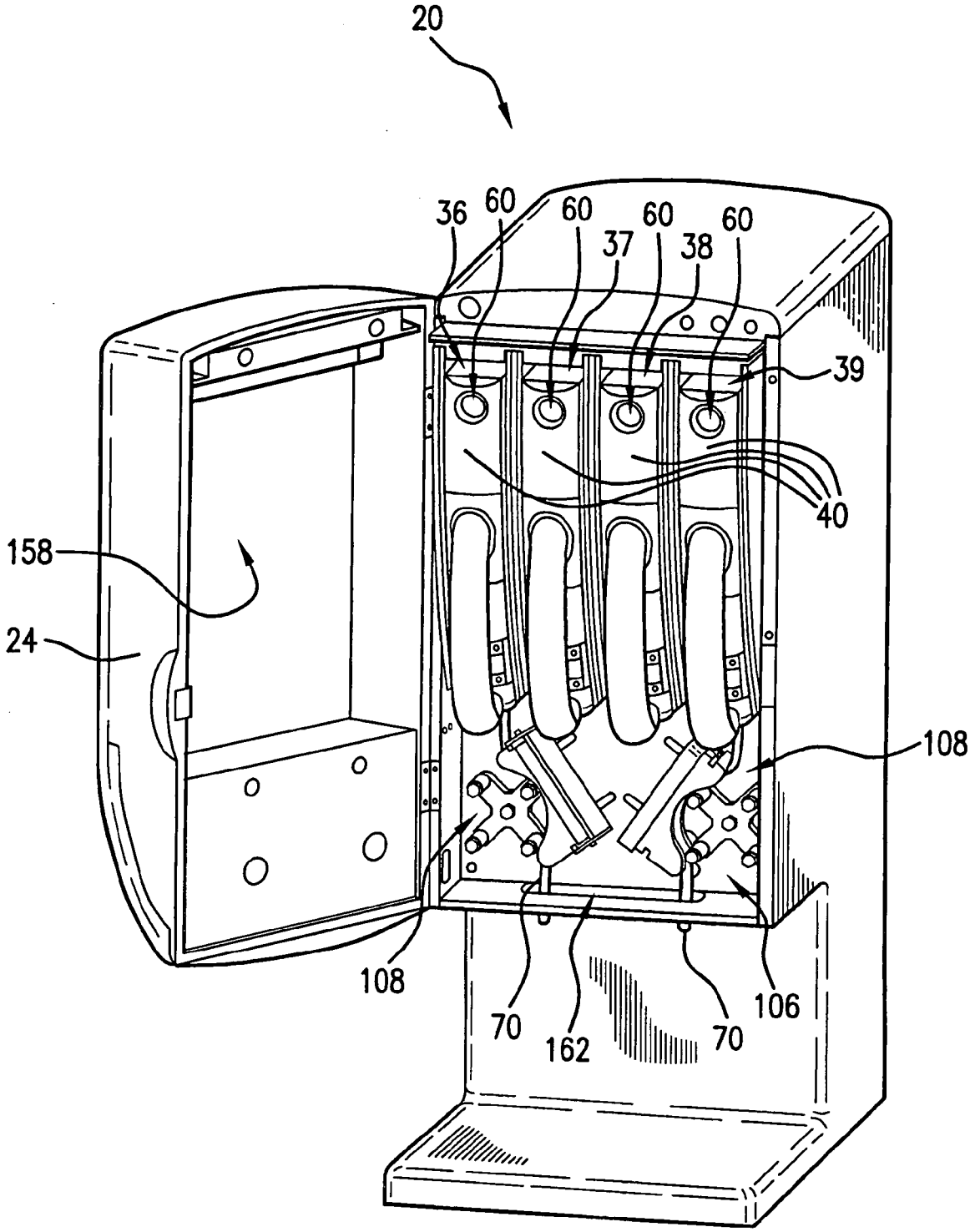
FIG. 2 is a perspective view thereof with cassettes received in bays of the dispenser.

A plurality of bays 36–39 that, as shown in FIG. 2, are preferably configured for receiving through a loading opening 41 a cassette 40 therein that contain pouches with a food product to be dispensed. In the embodiment shown, the dispenser 20 has four bays 36–39, each of which receives one cassette 40. The cassettes 4 preferably can fit in any of the bays and all of the cassettes 40 can be of identical or substantially the same construction.

Figure 3:
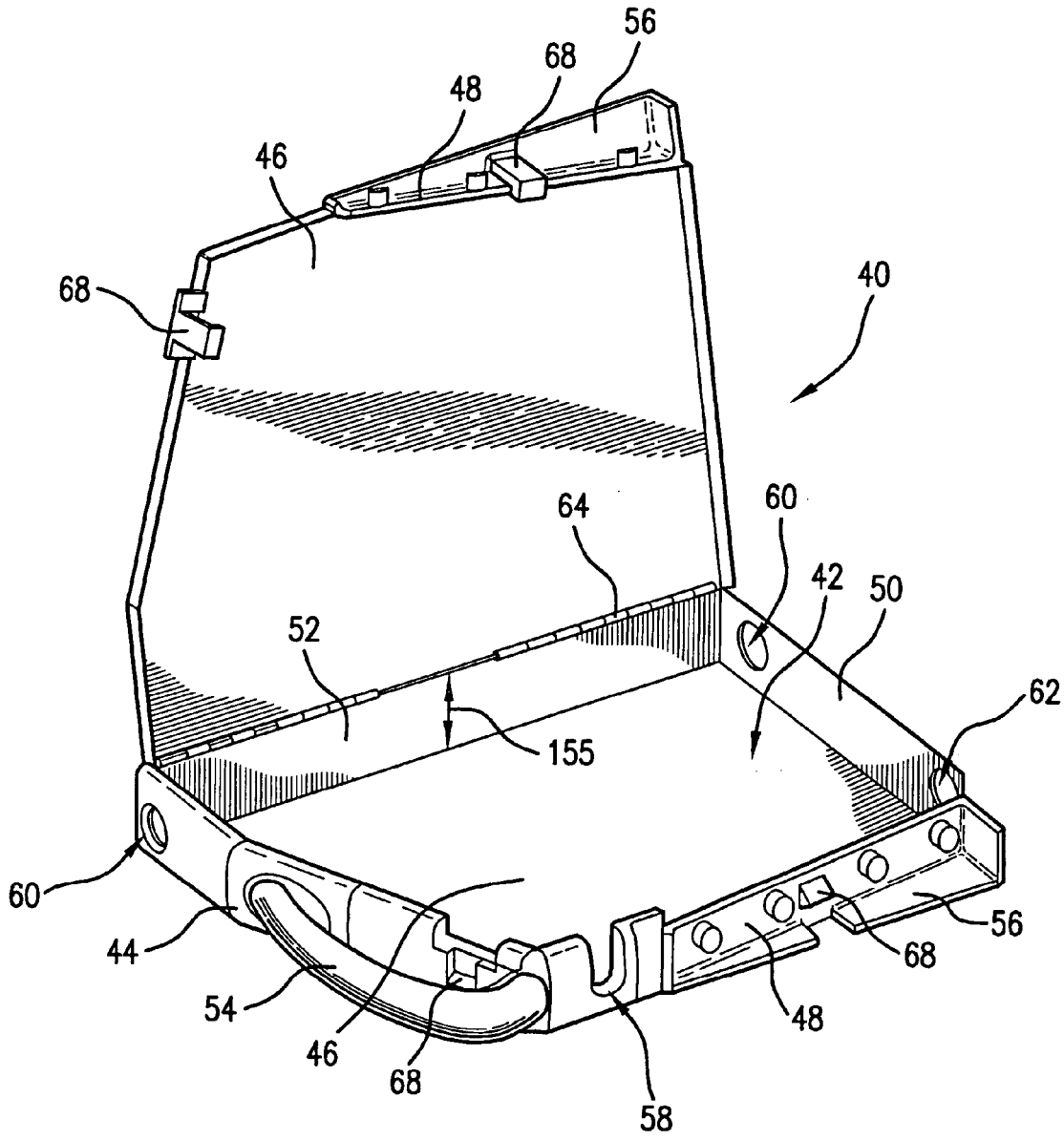
FIGS. 3 and 4 are perspective views of one of the cassettes in open and closed positions, respectively.
Figure 4:
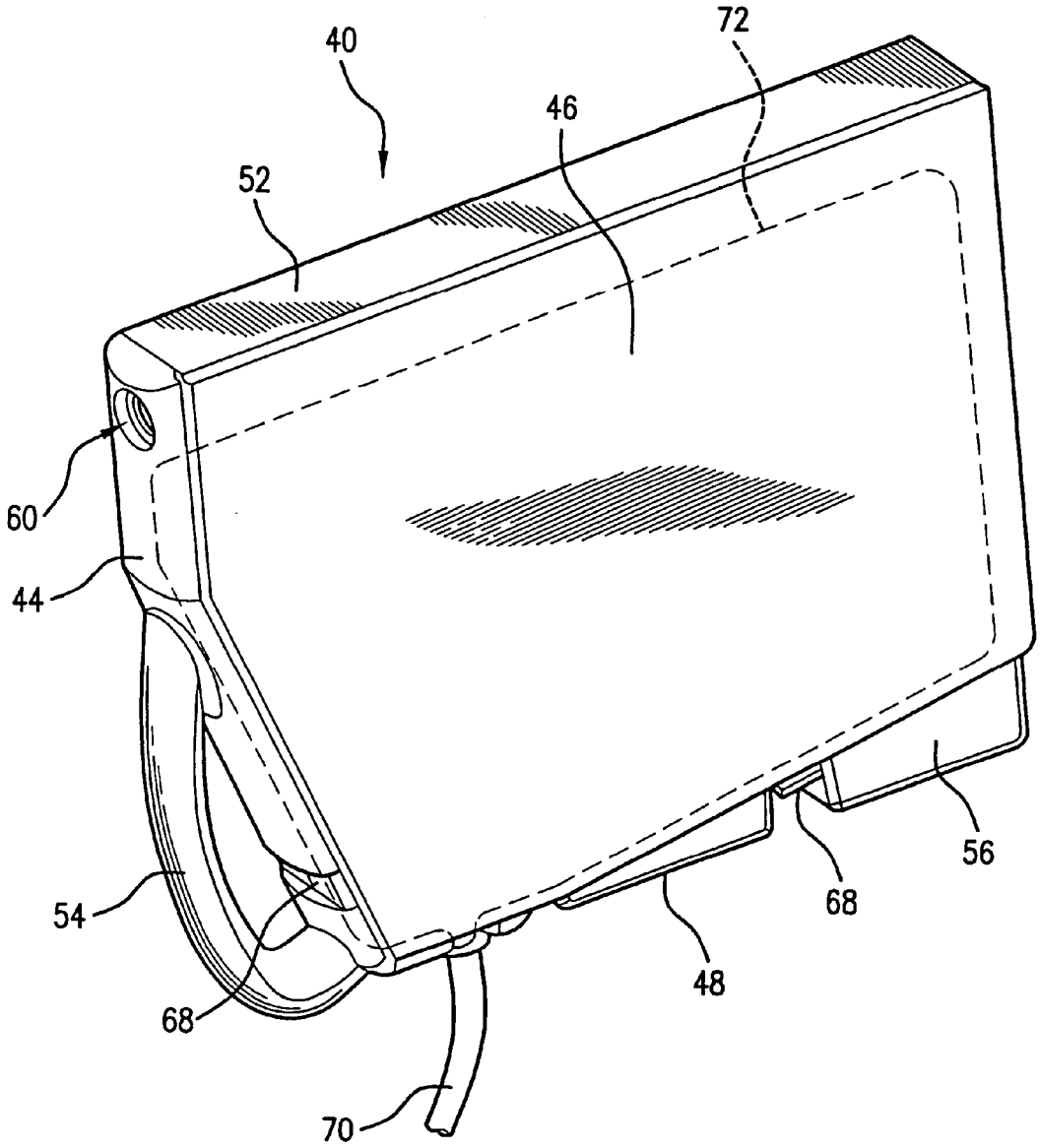

As shown in FIGS. 3 and 4, each cassette 40 is preferably constructed such that it is structurally substantially rigid to maintain its shape when a food package is loaded therein. The cassette 40 defines an interior 42 that is preferably substantially closed and is of sufficient capacity for receiving a food package, such as a flexible pouch, that is configured and dimensioned to intimately conform to the interior 19. The pouch preferably rests against the interior of the cassette 40 when in the dispenser, and in the preferred embodiment does not need to be hung from the top of the cassette, although this may be done in certain embodiments.

The cassette 42 may have a substantially rectangular external shape with a narrow lateral profile to reduce the amount of lateral space that it occupies in the housing and to support the pouch therein upright and in extensive contact with the cassette wall. The preferred cassette 40 has a front side 44, lateral sides 46 that are preferably configured substantially extensive with the pouch, a bottom side 48, a rear side 50, and an upper side 52. Cassette walls defining these sides are preferably made of 0.001 in. stainless steel to achieve the preferred structural rigidity and heat conduction, although other constructions can be used that achieve one or both of these functions. Also, the cassette 40 is preferably free of heating or cooling elements that are built as an integral part thereof. The front side 44 of the cassette 40 preferably has a handle 54 made of heat insulated material such as of thick plastic to facilitate handling of the cassette 40, prehension and access to the cassette 40 when the cassette 40 is inserted in the dispensing unit 20, as well as to facilitate insertion of the cassette 40 in the dispensing unit 20. The cassette 40 is preferably configured for sliding in and out of the bays 36–39. Sliding portions 56 assist in sliding against the bottom of the bays.

A cassette hinge 64 allows a side, preferably one of the large area lateral sides, to open and close, and latch elements 68 on opposite sides of the pivoting portions releasably latch the cassette 40 in the closed position. The latch elements 68 are preferably engageable to support a full pouch therein with the cassette 40 closed. In another embodiment, the hinge is replaced by additional latches that allows the releasable connection of two separate halves of the cassette.

An outlet 58 is defined preferably on the bottom side 48 of the cassette 40 receiving a discharge tube 70 of the pouch 72. The cassette 40 can have additional openings. Openings 60 are provided, preferably near the top end of the front and back cassette sides 44, 50 to allow heating or cooling air to flow into and out of the cassette 40 to help adjust and control the temperature of the food in the pouch. Opening 62 is preferably disposed near the bottom of the cassette 40, and preferably on the back wall, and is configured and dimensioned for permitting association of the pouch in the cassette 40 with a temperature sensing device to monitor the temperature of the food in the pouch. The positioning near the bottom side allows the temperature sensing device to sense the temperature of the portion of the pouch where the food is located, even after the pouch is mostly emptied.

Figure 5:
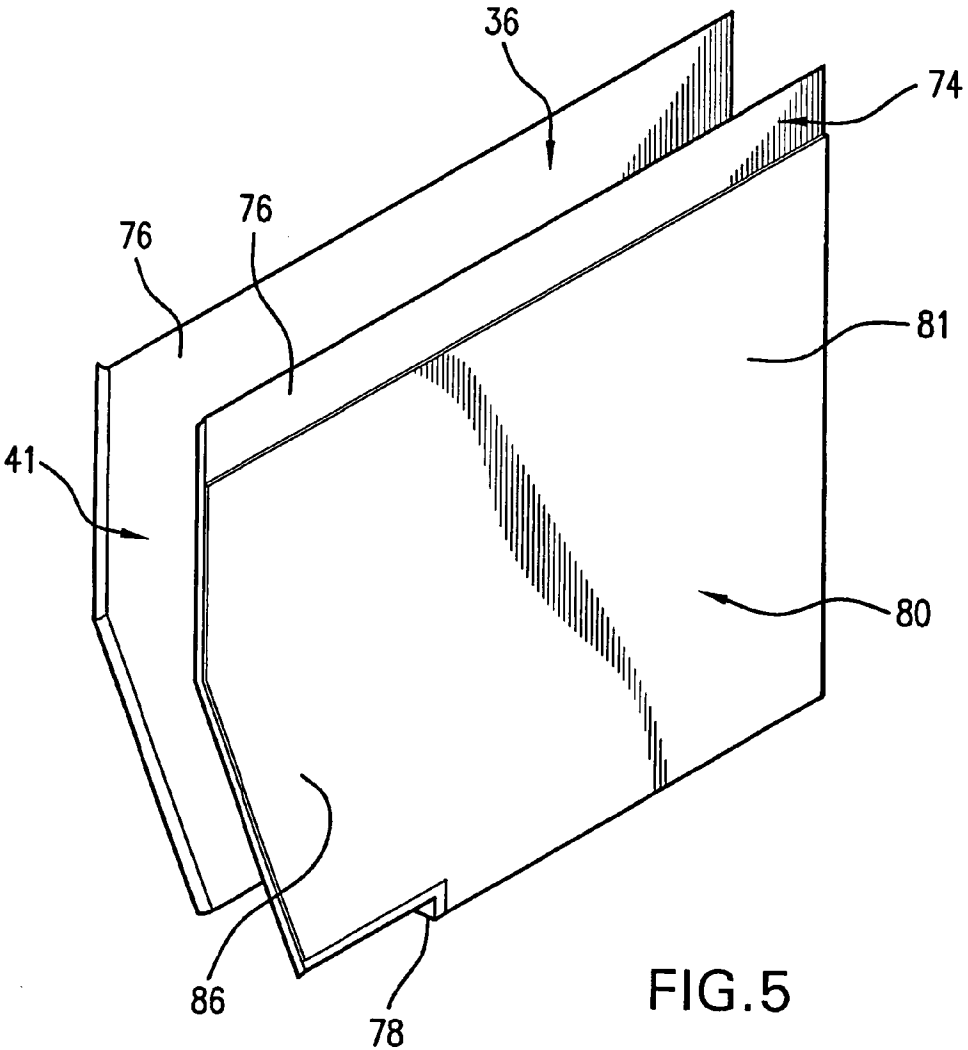
FIG. 5 is a perspective view of the construction of a bay wall and thin film heater of the dispenser.
Figure 6:
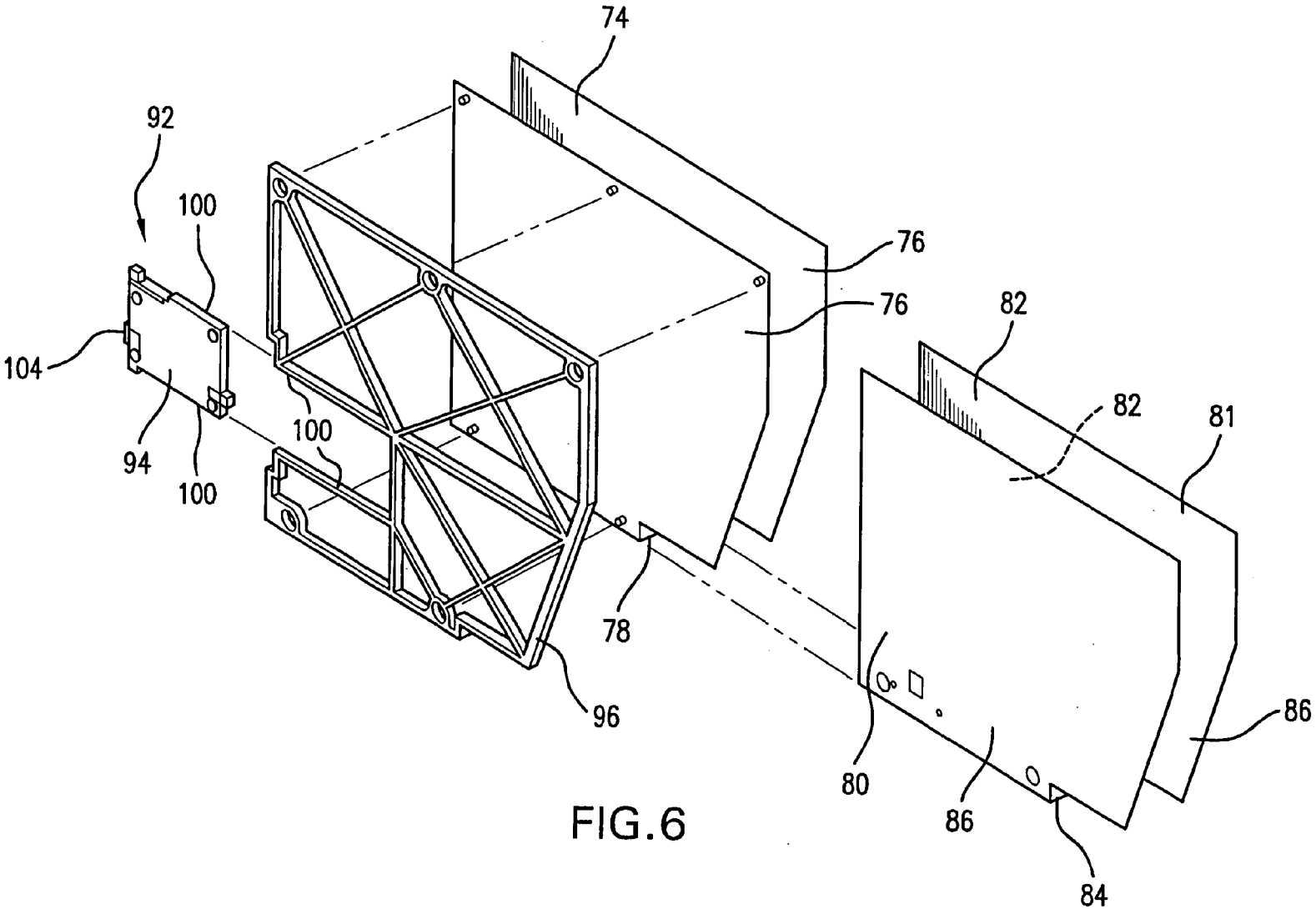
FIG. 6 is an exploded view of the construction of the bay.
Figure 7:
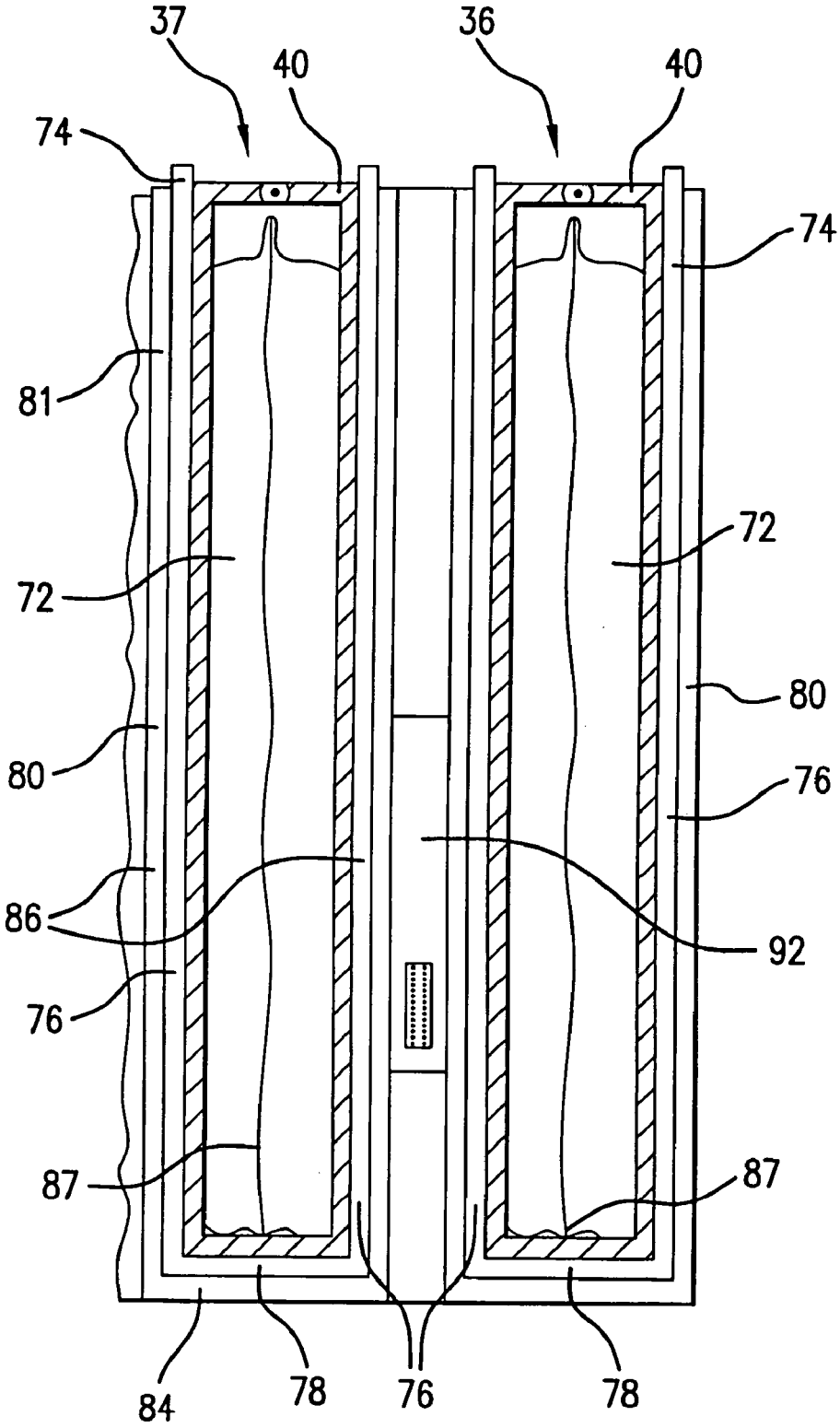
FIG. 7 is a partial cross-sectional view of two cassettes received in laterally adjacent bays of the dispenser.

Referring to FIGS. 5–7, the each bay 36–39 of the preferred embodiment has an internal wall 74, extending at least in a U-shape along the lateral 76 and bottom sides 78 of the bay 36–39. The inner wall 74 is configured and made of a material to intimately and extensively contact the cassette 40 and transfer heat efficiently thereto or therefrom, preferably by conduction. Preferably, the inner bay wall is substantially in thermally conductive contact with at least about 60% of the side walls of the cassette 40 at a level where the cassette 40 is in conductive contact with the full pouch 72 therein, more preferably at least 75%, still more preferably at least about 80%, and most preferably at least about 90%, while substantially 100% is possible as well.

A bay thermal-exchange unit 81 is associated with each of the bays 36–39 in heat-exchanging association therewith, such that the thermal exchange unit 80 are also in heat exchanging association with the cassettes 40 received therein for heating or cooling the pouches 72 in the cassettes 40. The thermal exchange unit preferably has portions that extend on the opposite lateral sides 46 of each bay 36–39 for heating or cooling the corresponding opposite lateral sides 46 of the cassettes therein. Preferably, the sides of the bay and cassette 40 that are heated or cooled are disposed substantially upright, and are preferably configured to maintain the contact between the portion of the pouch containing the food product with the heated or cooled walls of the cassette 40 as the amount of food product therein decreases.

In the preferred heated-food dispenser embodiment 20 shown, the thermal exchange unit 80 has a heater associated with, and preferably in intimate heat transferring contact with, the inner walls 74 of the bay. The preferred heater is a thin film heater, although alternative preferred embodiments can have another type of conduction based heater of sufficient and variable power density, electrically safe, easily cleanable and that can easily be formed in three dimensions to provide heat from different planes toward the interior of the cassette for quick but uniform heating of the food. Still other embodiment can have other types of heaters, such as convection heaters.

The preferred thin film heater element 81 is constructed with a relatively large durable heating panel that has preferably about the same area as the side of the cassette 40 that is adjacent the interior 42 where the heater's heat can be transferred to the pouch 72 therein to be heated in the bay. The area of the heater element in direct conductive contact with the wall 74 is preferably at least about 60% of the area of the side walls of the cassette in contact with that wall 74, and more preferably at least about 80%, and most preferably at least about 90%. The thin film heater element preferably provides a relatively low power density but efficient heating. The thin film element is employed here to heat the package confined in the interior of the cassette 40 while reaching a contact temperature that preferably not in excess of about 180° F., and preferably in a range about from 140° F. to 175° F. Due to the relative narrow profile of the cassette 40, the requirement for effective heating power to achieve the desired temperature is relatively low as compared to traditional electrical appliances, such as traditional ovens. For example, a Cal rod-type resistance heater usually operates with rod heating element at a temperature about ten times higher than what is required (i.e., about 1000–1500° F.) and a power density that usually exceeds 10 W/in.$^2$. The use of Cad rod heaters would likely cause non-uniform heating patterns and overburning potential, although in some embodiments, these may be employed. In the preferred heating embodiment, the heater provides an average watt density below about 2 W/in.$^2$, more preferably below about 1 W/in.$^2$, while conferring an even heating of the food product. The preferred heating elements provide uniform heating throughout the food product in the pouch 72 in the cassette 74, and can be designed with varying power density depending on the specific heating areas as desired.

The thin film heater is preferably initially formed as a flat flexible element. It has an electrically non-conductive surface, a thin film electrical conductor deposited on the non-conductive surface, and a pair of electrical terminals that are electrically coupled to the thin film electrical conductor. The non-conductive surface may form the upper surface of a substrate comprising an electrically insulating polymeric layer. The electrically conductive film is electrically isolated by the polymeric layer. The polymeric layer may be a 4-mil polyester layer or any similar durable, heat and shock resistant plastic material. The electrically conductive material most preferably is provided by a very thin film of conductive carbon-based ink or, alternatively, metal-oxide, for example, stannic oxide ($SnO_2$), nitrides, borides or carbides. The carbon-based ink may be deposited as a very thin film by printing on the plastic base. Then a clear adhesive plastic layer is layered on the printed surface to further protect the conductive track. The metal oxide film is most desirably deposited using a spray gun which atomizes and blows the metal oxide producing chemicals onto the polymer-based layer. Hence, the thin film becomes a molecularly bonded resistance film that is durable and can withstand repeatedly heating cycles without experiencing failures. Durability of such heaters is usually better than any other types of resistance heaters such those formed by adhering resistance heater wires to a substrate or when encircling a tubular substrate with a silicone blanket. Other solutions include chemical vapor deposition, which is a more expensive technology, silk screening, painting or other known techniques. The electrical terminals are spaced apart and connect the carbon based or metal oxide conductive track. A bus bar strip is provided along the periphery of the element and a second bus bar strip is provided along the center line of the element so as to distribute current substantially evenly all along the conductive layered surface. The bus bar terminals can be typically formed by silk screening techniques using, for example, silver or nickel-silver alloy, to form the bus bar. The thin film using a carbon ink conductive track printed on a polyester layer can be manufactured by Calorique, West Wareham, Mass. A useful thin film heater construction is disclosed in U.S. patent application Ser. No. 10/032,170, filed Dec. 21, 2001, the contents of which are hereby expressly incorporated herein by reference thereto.

The thin film heating element 80 is formed from a preferably flat resistance evolute surface 82 that preferably extend on the opposite sides of largest area, preferably corresponding to the lateral sides of the bay and cassette 40, which are spaced by the smallest dimension of the interior 42 of the cassette. The flat heating element is configured to bend between the lateral and bottom portions 76, 78 of the bay. Although the thin film heater 80 may have heating regions 86 configured to heat on the lateral and bottom bay sides 76, 78, the portion of the heater 80 on the bottom side 78 is preferably a substantially non-heating region 84 and preferably is substantially free of heating resistance regions. The non-heating region 84 extending along the bottom bay side 78, however, preferably includes an electrically conductive portion to electrically connect the heating regions 86 such that the heating regions may be engaged or disengaged as a single heating unit.

The opposite lateral sides 76 of the interior of the bay and preferably also of the heating regions 86 are preferably at least twice as tall, or at least twice the smaller of the horizontal width and vertical height, as the bottom side 78, more preferably at least three times, and most preferably at least four or even five times. The thermal exchange unit preferably extends in a U-shaped vertical cross-section about the respective bay, as explained above, with the heating regions 86 on the vertical lateral sides 86. The preferred opposed sides that are heated are also spaced across the loading opening 41 to slidably receive the cassette 40 therebetween.

The heating pattern of the heating unit 80 can be modified depending upon the heating requirements by producing various conductive tracks in the different resistance regions to heat the bay and cassette, depending on the dispenser, in a very uniform manner. In particular, following Ohm's Law, areas of higher power density can be obtained by proportionally increasing the width of the conductive track. Conversely, when a lesser density is needed, the track can be made thinner.

The preferred pouch 72 used in the embodiment described is disposable, substantially rectangular or polygonal, and thin-walled and is adapted to contain a flowable food product to be dispensed. The flexible pouch 72 is made of plastic or another suitable film material that can withstand heat, i.e., temperature in excess of 140° F. The film may be of a material such as polyethylene, polyamide or PA/EVOH/PA laminate. The pouch 72 preferably comprises two extensive lateral sides sealed together along a peripheral sealed edge 87. Secured to the bottom corner region of the pouch side is a fitment that defines an outlet for dispensing the food product. In a preferred embodiment, the bottom corner region has a truncated corner to reduce the dead zone that is submitted to folding when the pouch is put into place in the cassette 40. Preferably, the fitment is located in region at a distance from the sealed edge 87 of the pouch that is sufficient to provide a proper folding of the corner region along a line that is inclined with respect to the median longitudinal plane of the pouch. If this distance is too long, the portion submitted to folding may be too large which would cause problems to evacuate product from dead zones of the folded portion. If the distance is too short, the portion may have difficulties to fold properly and it may be difficult to engage the fitment through the passage. Furthermore, if the distance between the two plies of the pouch 72 is too short due to the proximity of the corner, it could cause a problem to engage the spacer with risks of accidentally puncturing the pouch. The cassette 40 is configured such that the outlet of the fitment is put in a position that is the lowest of the pouch thereby improving the evacuation of the food in the cassette. At the same time, the body of the pouch has its two main sides intimately contacting the larger heating surfaces of the cassette thereby rendering the heat transfer particularly effective. A preferred pouch in disclosed in U.S. application Ser. No. 10/032,170. Alternatively, the pouch can also have a fitment attached to the bottom edge as disclosed in U.S. Pat. No. 6,419,121. The fitment assembly is preferably constructed as disclosed in U.S. Pat. No. 6,378,730.

Figure 8:
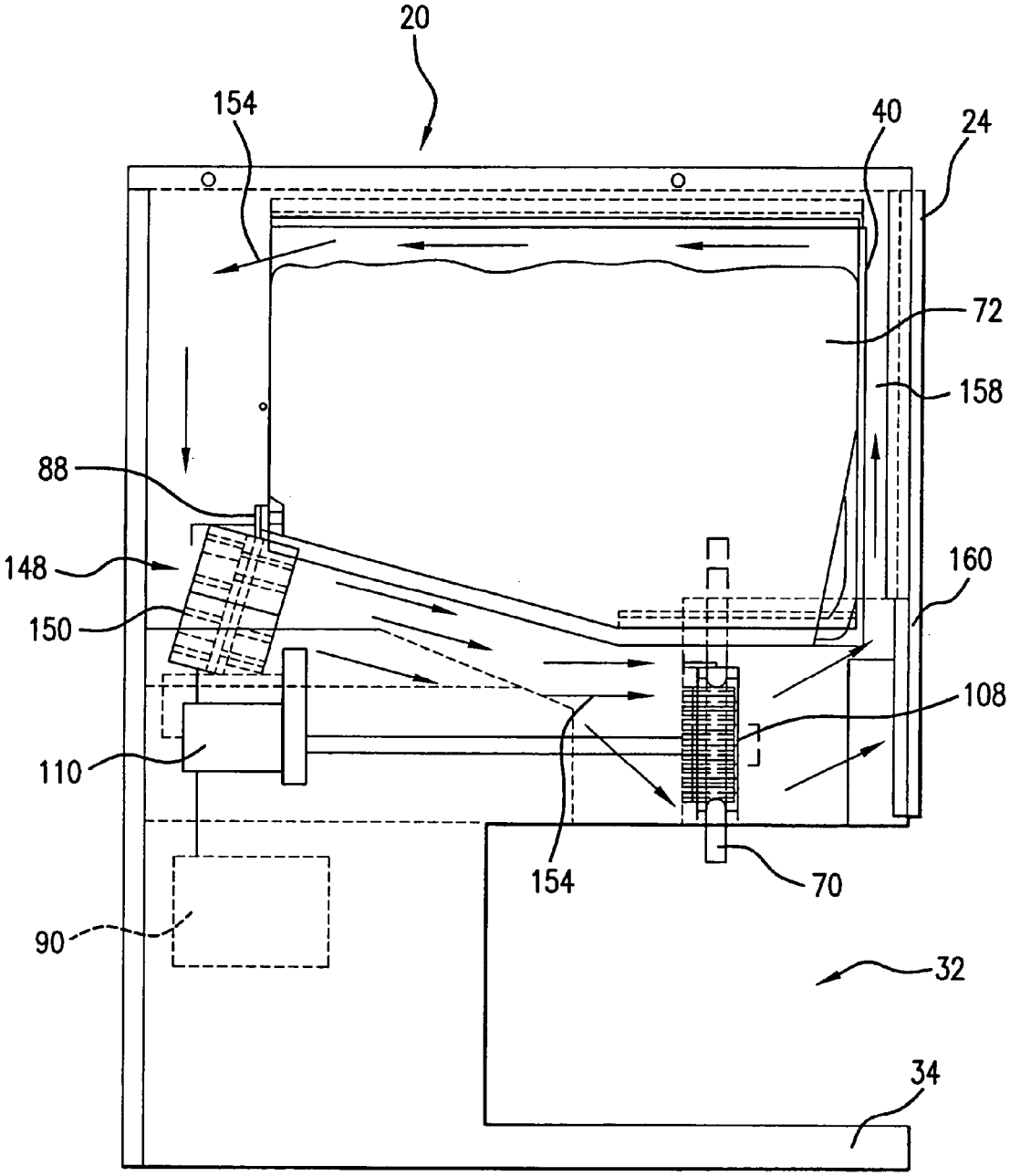
FIG. 8 is a schematic lateral view of the dispenser showing the airflow circulation path from a pump heater and blower.

As shown in FIG. 8, a temperature sensor 88 of the preferred embodiment extends into each bay 36–39 in alignment with opening 62 for reception therethrough. The sensor 88 is positioned and configured to sense the temperature of the pouch 72 within the cassette 40 and the food product therein. The preferred sensor 88 is a thermistor that is preferably configured for directly contacting the pouch 72 within the cassette 40. A control system 90, preferably housed and mounted to the housing, is associated with the thermistor 88 and the thermal exchange devices for operating the heating units 80, or cooling units in a cooling embodiment, depending on the sensed temperature. The control system 90 is preferably controls the thermal exchange units 80 independently for independently heating or cooling the cassettes 40 in the bays 36–39. This permits cooler or warmer pouches to be heated or cooled as necessary, at independent temperature ranges and time, without undesirably affecting the other pouches. As the opening 62 and the thermistors are located near the bottom of the cassette 40, the temperature of the food product can be accurately sensed as the product drains out toward the bottom of the pouch 72.

Preferably, if the temperature sensed by the thermistor 88 is found below a threshold value, e.g., 120° F., control system 90 cause the appropriate bay heater to enter a boost cycle and boost the heater under proportional power control and, the based on the sensed temperature from a heater thermistor 98 measuring the temperature of the heater (as described below), will control the respective heater temperature to a boost elevated set point, e.g., 175° F. plus or minus a tolerance value. As a result, if proportional control is chosen, the power sent to the particular heater 80 will proportionally increase according to the differential between the product temperature to the new set point. Such a proportional power control has the benefit to favor a rapid heat-up of the food in the package while ensuring security with no risk of overshooting as the set point is progressively reached with a decreasing electrical power sent. The boost cycle will be maintained until the thermistor 88 reaches a product temperature set point corresponding to the desired product temperature at the bottom of the cassette, e.g., 150° F. plus or minus a tolerance value. Once the product in the bottom of the cassette 40 has reached the set point, the product thermistor 88 takes over the control, and the control system 90 will set a new heater set point, i.e., a monitoring set point, for the heater thermistor 98 lower than the boost elevated set point. The temperature control is thus changed into a monitoring mode and the control system 90 will control the heater not to exceed the heater monitoring set point, e.g., 165° F. In the event, the pouch 72 has been previously heated to a temperature higher than the threshold temperature initially sensed by the product thermistor, for example, if the product in the bottom of the cassette is between 121° F. and 140° F., the control system 90 will not activate the boost mode and will instead go to the maintenance mode, controlling the heater through the product thermistor 88.

The control system 90 also preferably controls the on/off activation, such as via relays, of the pump heater 152. Thermistors or other temperature sensors are configured to sense the pump temperatures for controlling the pump heater 152. These thermistors associated with the pump 108 can be disposed inside the stators 104 to provide feedback signals to the control system 90 to control the pump heater 152 activation.

Figure 9:
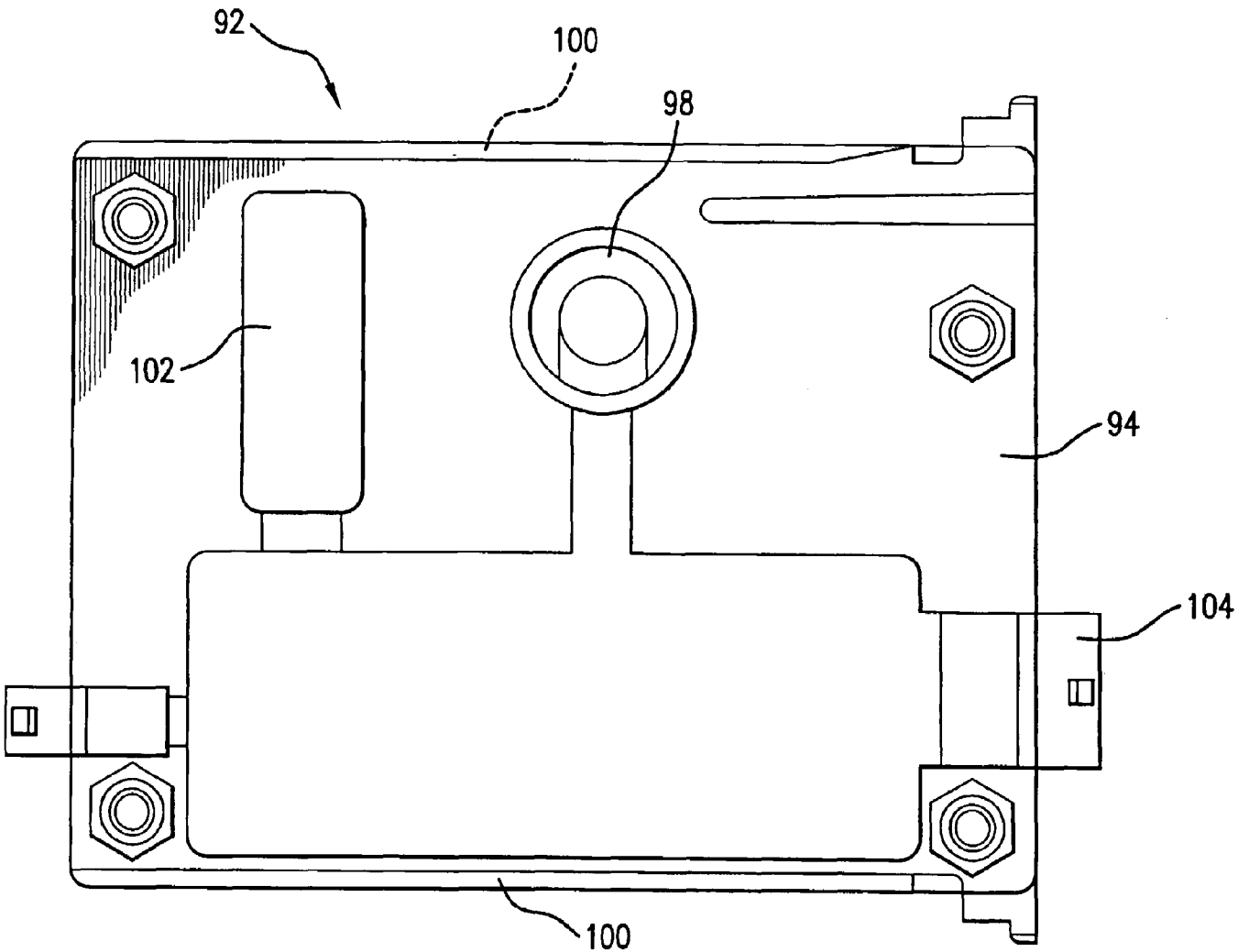
FIG. 9 is a lateral view of a temperature limit device thereof.
Figure 10:
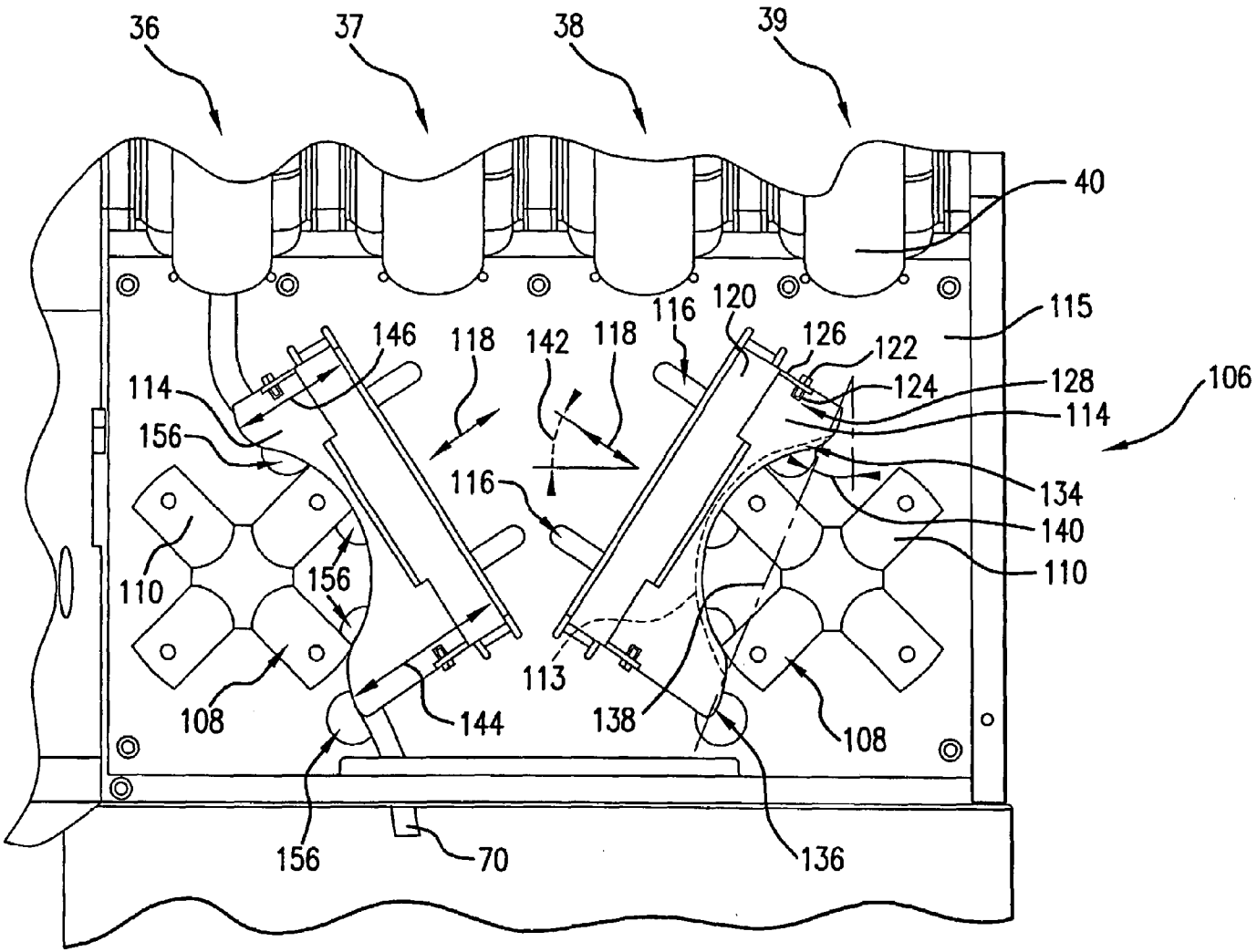
FIG. 10 is a front cut-away view of the device showing the pumps thereof in pumping positions.

Referring to FIGS. 6, 7, and 9 the preferred dispenser includes one or more temperature limit units 92, and most preferably, each thermal exchange unit 80 is associated with one temperature limit unit 92. The temperature limit units 92 preferably are constructed on a plate structure 94 that is slidably receivable in a frame 96, which supports the walls of the bays 36–39. Heat insulation is disposed within the frame between the laterally adjacent bays 36–39 and on the outside of the row of bays 36–39 as well to help individually control the temperature of the bays 36–39 and reduce the transfer of heat from one to the other. Except for one of the temperature limit units 92 disposed near the lateral end of the dispenser 20, three of the temperature limit units 92 are disposed between adjacent pairs of bays. To minimize the lateral space occupied by the temperature limit units 92, the units 92 are placed between the bays with a thin lateral profile and can be guided by tracks 100 on the top and bottom thereof and of a slot in the frame 96. Additionally, plug connectors 104 are provided preferably on the backside of the plate 94 to electrically connect the temperature limit units 92 to the control system 90 and thermal exchange units 80.

The temperature limit units 92 are configured for sensing a temperature beyond a predetermined limit to protect the dispensing device and/or the food product therein. In a heating embodiment, the limit is a maximum temperature, and in a cooling embodiment, the limit is a minimum temperature. The temperature limit units 92 are associated with the control system 90 and/or the individual thermal exchange devices 80 to keep the thermal exchange device 80 substantially within said limit and to prevent over heating or over cooling, preferably by shutting off the thermal exchange devices 80 associated therewith.

The temperature limit unit 92 shown in FIG. 9 has a thermistor 98 in contact with the heating region 86 of a heating device 80 adjacent thereto, although other types of temperature sensors can be used in alternative embodiments associated with the thermal exchange device. A second temperature sensing device, which is preferably a fuse 102 also associated with, preferably in contact with, the heating region 86. Either sensor, the thermistor 98 or the fuse 102, is capable of independently deactivating the heating device 80 when the temperature is beyond the temperature limit.

A dispensing mechanism 106 is associated with at least one of the bays 36–39 for dispensing the food from the pouches that are in the cassettes 40 received in the bays. Although in certain embodiments other types of mechanisms can be employed, the preferred dispensing mechanism is a volumetric displacement mechanism, such as peristaltic pumps 108, as shown in FIGS. 1, 2, and 10–12 for dispensing accurately food portions. The pumps 108 of the preferred embodiment are disposed below pairs of adjacent bays 36, 37 and 38, 39 for pumping association with dispensing bays 36 and 39. No pumps are provided for bays 37 and 38, which are preheating, or temperature setting, bays that can receive a cassette 40 with a newly inserted pouch 72 and bring it to the desired temperature before transferring the cassette 40 to the dispensing bays 36, 39. Each of the preferred pumps 108 is thus disposed and configured for pumping the food product from one of the bays and not the others, or at least to facilitate pumping from one bay while it would be more difficult or impossible, depending on the embodiment, to pump from the others. To reduce the lateral footprint of the device, the pumps 108 are disposed generally in a direction of the extension of an axis extending between the heated opposite lateral sides of the bays, which in the preferred embodiment, places the pumps 108 below one or pairs of bays.

Each pump 108 receives the discharge tube 70 extending from the pouch in the cassette 40 and bay associated therewith. The pumps 108 have rotor 110 that is rotatably driven by a motor 112, shown in FIG. 8. A stator 114 of each pump 108 is shown in a pumping position relative to the rotor 110. In the pumping position, rollers 111 compress the discharge tube 70 against compression race 113 of the stator 114 and peristatically pump the food product from discharge tube upon rotation of the rotor 110. The stator 114 has a substantially arcuate shape to conform to the shape of the rotor 110 in the pumping position for a pinching the discharge tube 70.

Figure 12:
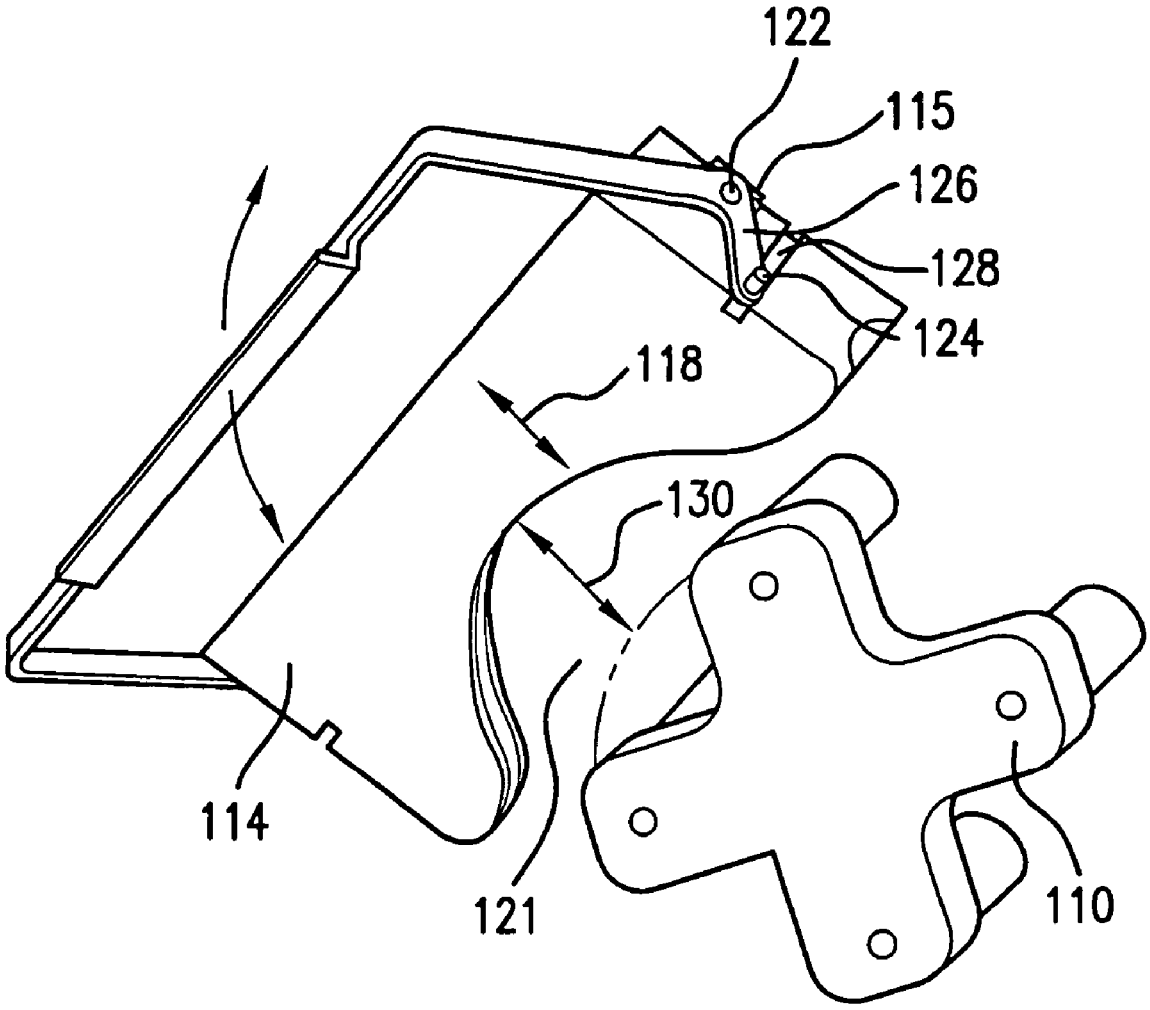
FIG. 12 is a partial perspective view showing the loading mechanism of one of the pumps.

The stator 114 is mounted to the support structure 115 of the dispenser 20 to move relative to the rotor 110 to a loading position to increase the space 130 from the rotor 110 sufficiently to load and remove the discharge tube 70 from therebetween. In FIG. 12, the possible positions of the rotor 110 are shown as phantom line 121. Preferably, the stator 114 is slidable along tracks 116 in directions 118 between the pumping and loading positions. A handle 120 is pivoted to the dispenser support structure 115 at pivot 122, which has an axis extending about along the front of the dispenser 20. The handle 120 has an L-shaped lever 126 with a cam pin 124. Cam pin 124 is received in cam race 128 of the stator 114. The cam race 128 can extend in a substantially straight or curved line, and preferably extends towards and away from the front face of the dispenser and is configured for causing the sliding of the stator 114 when the handle 120 is pivoted. This construction reduces the space occupied on the front face of the dispenser 20 when the stators 114 are in the pumping positions.

Figure 11:
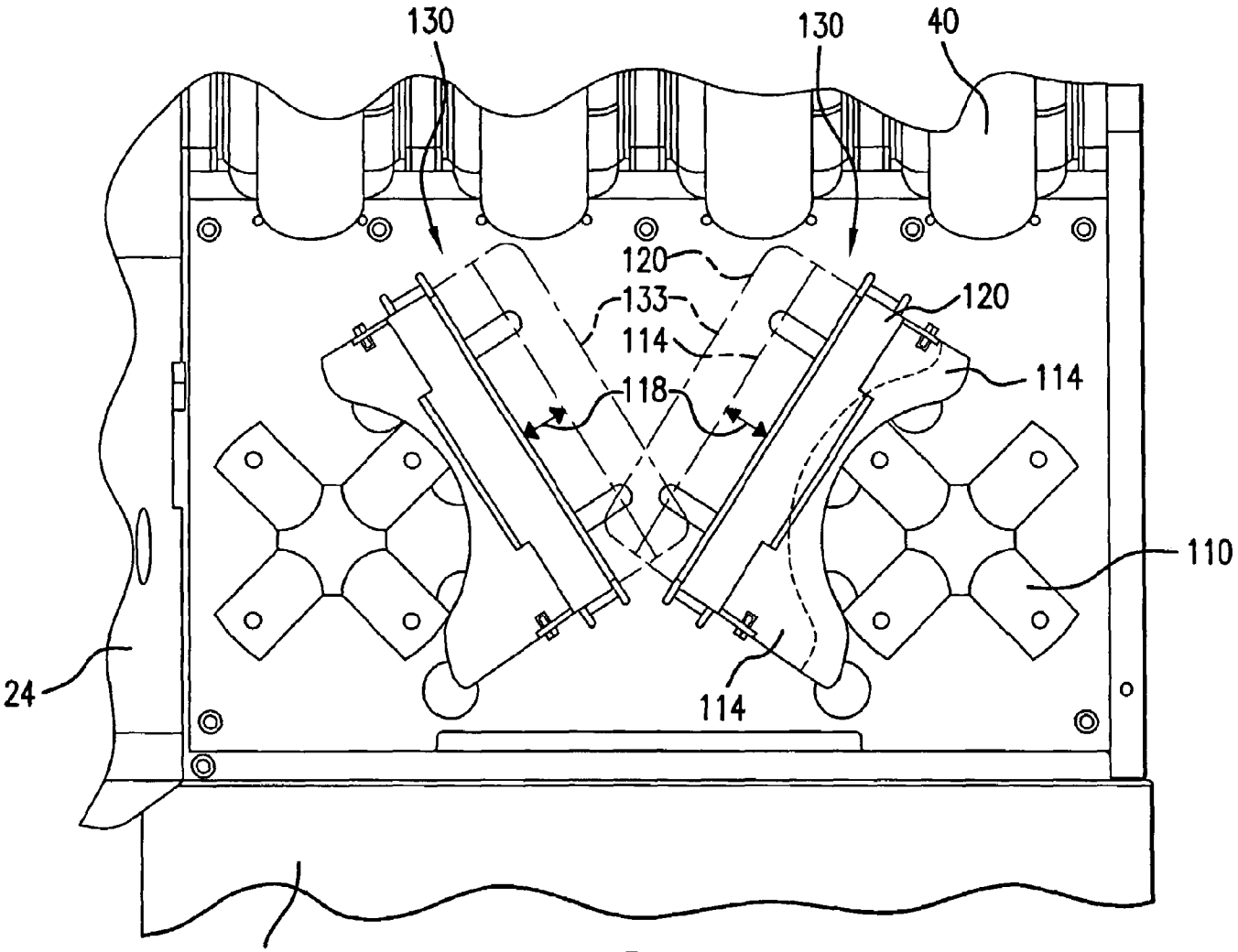
FIG. 11 is a front cut-away view thereof showing the movement of the pump stators to loading positions.

As shown in FIG. 11, the loading positions 133 (shown in phantom lines) of the stator assemblies 130, which include the stators 114 and/or handles 120, overlap with each other. Thus, only one of the stators assemblies 130 can occupy its loading position 133 at any time. This is preferred as the lateral space needed for loading can be shared by the pumps 118 can be reduced, thus reducing the footprint of the dispenser 20 as a whole, and the loading positions can be disposed for substantially minimizing the width of the dispenser 20, including the axis of rotation of the rotors 110 substantially aligned with the depth of the bays, and the stators 114 being slidable laterally with respect thereto.

Also to reduce the lateral width required by the dispensers, the loading position 133 for each stator assembly 130 is displaced diagonally with respect to the horizontal, along directions 118, from the pumping position. The loading positions can be displaced from the pumping position at an angle 142 of about between 10° and 80° with respect to the horizontal, more preferably about between 300 and 60°, and most preferably about between 40° and 50° from the horizontal.

The curved compression race 132 of the each stator 114, which is configured for receiving and compressing the discharge tube 70 against the rotating rotor 110, has an input and output ends 134, 136. The rotor 110 is operated for pumping the food product from the input end 134 to the output end 136. To help reduce the lateral footprint of the dispenser 20, in one or both of the loading and pumping positions, a line 138 extending between the input and output ends 134, 136 is disposed diagonally with respect to the vertical, preferably at a stator angle 140 of about between 10° and 80°, more preferably about between 20° and 50°, and most preferably about between 25° and 40°. As a result of this angle, the input and output ends 134, 136 are displaced horizontally with respect to each other in the preferred embodiment.

The stator angle 140 with respect to the vertical is preferably less than the angle of directions 118 with respect to the horizontal. This allows minimization the lateral footprint while avoiding excessive inclination of the stator angle 140, although alternative embodiment has a stator angle 140 greater than angle 142. To achieve preferred difference in the angles, the preferred embodiment of the stator 114 has a greater width 144 measured along direction 118 at the outlet end 136 than width 146 at the inlet end 134. Width 146 is preferably less than about 90% of the width 144, and more preferably less than about 80%.

Referring to FIG. 8 a pump thermal exchange unit 148 is associated for heating or cooling the pumps and the discharge tubes 70 that extend therethrough. In the preferred heating dispenser embodiment shown, the pump thermal exchange unit 148 includes a resistive heating element 152 and a blower 150 associated for heating and circulating air to the pumps 108 and other parts of the dispensers as desired.

The preferred circulation path of the heated air in the preferred embodiment is shown by arrows 154. The blower 150 and housing 22 of this embodiment are preferably configured for circulating the heated through heating openings 156, which are disposed to direct the air for heating the stator 114 and rotor 110, as well as the discharge tube 70. The heated air is also circulated to heat some of all or the sides of the bays 36–39, cassettes 40 and pouches 72 therein that are not heated by the bay thermal exchange units 80, which in the preferred embodiment are the bottom, top, front, and back sides.

After passing through the pumps 108, the air circulation path 154 passes along the front of the bays 36–39 through recess 158 in the front panel 24, as shown in FIG. 2, heating the front sides 44 of the cassettes 40. Thereafter, the air passes into the cassette 40 through openings 60 to directly heat the top side of the pouch 72 and the air generally within the cassette 40. A portion of the circulation path 154 can also extend outside of the cassettes 40 on the top sides 54 thereof. The air exiting the cassettes 40 is directed down around the back sides 50 of the cassettes 40 and back to the heater 152 and blower 150, preferably such that the circulation is closed, with the air returning to the pump thermal exchange unit 148 for improved efficiency. The air leaving the blower preferably heats the bottom sides 48 of the cassettes 40. The circulation flow path 154 of the preferred embodiment is thus generally about an axis connecting the heated lateral sides 86 of the bays 36–39, with flow over the lateral sides of the bays being blocked as the bays about each other closely.

The bays 36–39 with the embedded heaters 80 and convection heater 152 and blower 150 described preferably has the ability to heat an amount of flowable food at or above 2 Kg, from ambient to a temperature above 140° F. in less than about 2.5 hours, more preferably in less than about 2 hours, and most preferably in less than about 1.5 hours. The internal dimensions of the cassettes 40 are chosen to improve the heating time and heating uniformity, as explained above. Thus, the interior of the cassettes 40 have an interior lateral width 155, as shown in FIG. 3, measured between the lateral walls of the cassettes 40 that are in heated contact with the lateral walls of the bays 36–39. The spacing 155 is preferably less than 2 inches, more preferably less than 13/4 inches, and most preferably of about between 1.0 to 1.75 inches. Remarkable results have been obtained by dimensioning the spacing 155 at 1.57 inches.

When the preferred narrow cassettes 40 and bays 36–39 are used, the total capacity of the package in each cassette has little or no effect on heating time or heating uniformity. The heat-up time for the package can be achieved in less than an hour almost irrespective of the amount of product in the package. The reduced spacing also contributes to a more uniform heating of the package with absence of hot and cold spots in the product. In conjunction with the cassettes' proportions, it has also been determined that the average power density delivered from the lateral sides 46 of the cassette are preferably at least about 0.3 W/in.$^2$, and more preferably about from 0.3 W/in.$^2$ to 0.8 W/in.$^2$, and most preferably about from 0.45 W/in.$^2$ to 0.65 W/in.$^2$. It has also been determined that the power density should preferably have zones of higher power density and zones of lower power density to adjust the heating pattern as a function of the location in the cassette. To compensate the natural tendency of hot air to move upward, the wattage density should preferably be varied along the height of the bay to provide more power in low areas and less in the upper areas of the bay, although employing the convection heater with circulating air helps to reduce the effects of the rising hot air. In one embodiment, the heater pattern of the bay thermal exchange heaters 80 are vary about from 0.45 to 0.65 W/in.$^2$ from the lower areas to the upper areas of the bays 36–39.

The pump 108 can deliver portion control of food upon a push of a corresponding button 160 of a use control, such as located on the front exterior of the front panel 24. The presence of a cassette 40 in the dispensing location is preferably detected by the controller 90. If the cassette 40 is in one of the dispensing bays 36, 39, the controller 90 will run the corresponding pump 108 according to a portion duration stored in a preferably non-volatile memory of the controller 90, or alternatively for the duration of the control activation.

Figure 13:
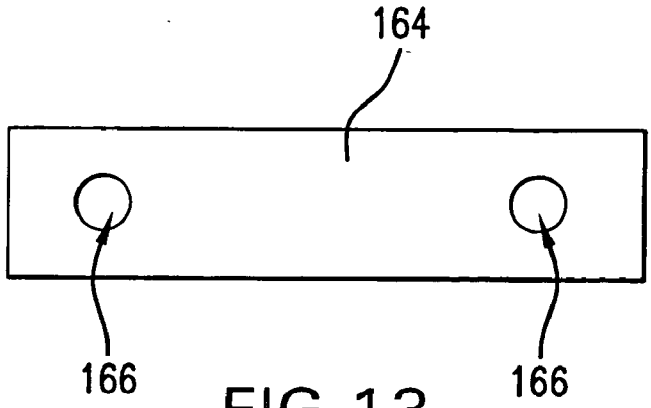
FIGS. 13–15 are top views of various embodiments of dispensing guides.

Referring to FIGS. 1 and 2, the housing 22 defines a dispensing opening, which in the embodiment shown includes a laterally elongate slot 162. A dispensing guide 164, as shown in FIGS. 1 and 13, is preferably placed over the slot 162 and includes two dispensing guide holes 166 that are aligned therewith for aiming the discharge tubes 70 and their exit openings, through which the food product is dispensed, of each pouch that is in a cassette 40 in a dispensing bay 36, 39. In the embodiment shown, the holes 166 are spaced to deliver the product to two different locations that are spaced laterally from each other.

Figure 14:
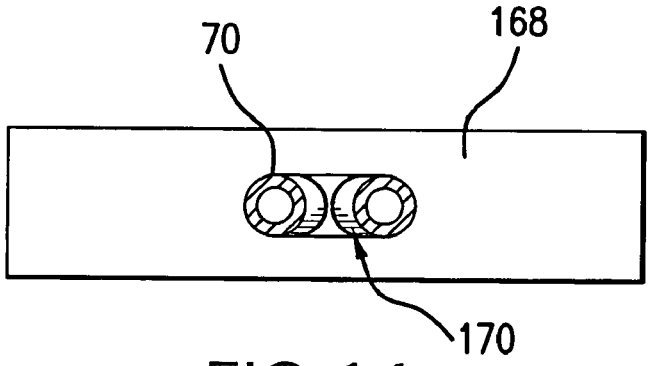

The dispensing guide 164 can be replaced with dispensing guide 168, shown in FIG. 14, which defines a narrow slot, or alternatively two closely spaced holes to aim the both dispensing tubes 70 to dispense the food product a substantially a same location or sufficiently closely to simultaneously dispense in a single receptacle in the dispensing area 32. Thus, the aim of the discharge tubes 70 and the distance they are and they aim from each other can be adjusted by replacing the dispensing guide. When the narrow aiming dispensing guide 168 is employed, a single control activation or button push by the user can cause the controller 90 to activate both pumps 108 simultaneously.

Figure 15:
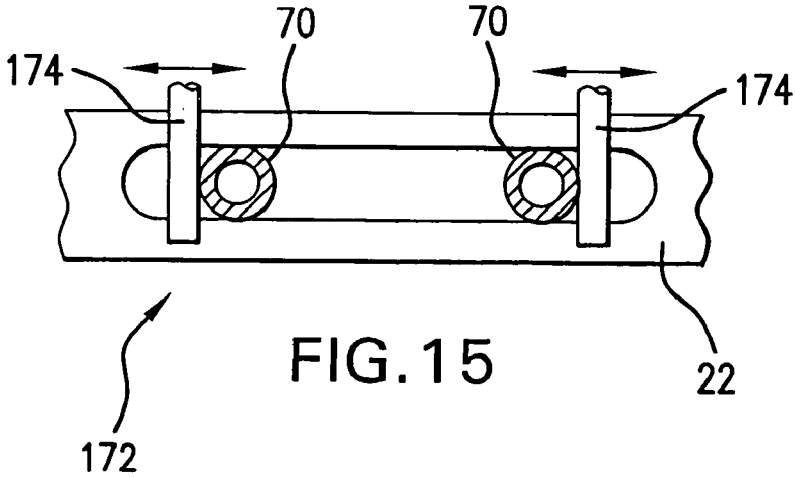

FIG. 15 shows an alternative dispensing guide 172 that includes laterally movable guide members 174 to move the discharge tubes 70 closer together or to allow them to be more spaced from each other. The guide members 174 can be manually positionable, or they can be automatically moved under the control, for example, of the controller 90.

In one embodiment, the operation of the pumps depends on the configuration of the dispensing guide. If the guide is configured for dispensing the food product to two separate and spaced locations, the controller will allow independent operation of the pumps 108. If the dispensing guide is configured for dispensing at very close locations, substantially at the same location for filling a single receptacle, the pumps can me operated jointly by a single user control input.

Figure 16:
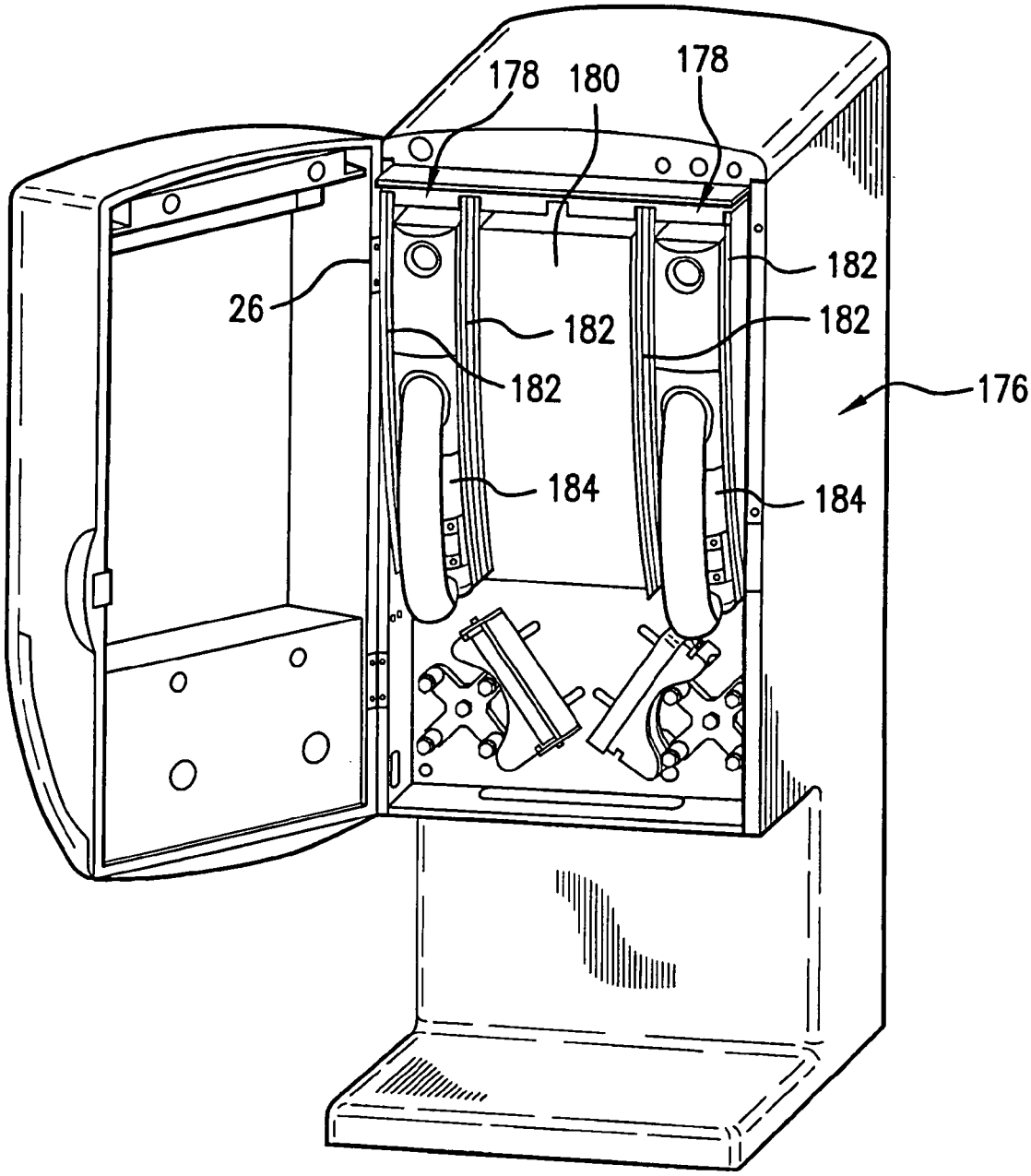
FIG. 16 is a perspective view of an embodiment of a cooled-food dispenser constructed according to the invention.

Referring to FIG. 16, a cooling embodiment of a dispenser 176 has bays 178 disposed on opposite sides of a cooling mechanism 180. The cooling mechanism provides cooling to cooling thermal exchange units 182, which are preferably disposed on opposite sides of each bay 178 to cool the cassettes 184 disposed in the bays. Preferably, thermoelectric coolers (TEC) are employed to cool the bays 178. Although the embodiment shown does not have temperature setting, or precooling, bays, an alternative embodiment may have such bays, and more bays than pumps or other dispensing mechanisms. A blower preferably cools the pumps 186 and the cassettes 184 in the bays 178 with a circulation path of cold flowing air similar to that shown in FIG. 8.

While illustrative embodiments of the invention are disclosed herein, it will be appreciated that numerous modifications and other embodiments may be devised by those skilled in the art. Therefore, it will be understood that the appended claims are intended to cover all such modifications and embodiments that come within the spirit and scope of the present invention.

What is claimed is:

1. A flowable food dispenser for dispensing flowable food product, comprising:

a housing having first and second bays;

a plurality of cassettes removably receivable within the bays, each cassette configured for receiving a pouch containing the food product;

first and second thermal exchange devices associated with the first and second bays, respectively, in heat-exchanging association with the cassettes received therein, wherein the bays have internal walls associable with the cassettes received therein for substantially extensively contacting the respective cassette to conductively transfer heat between the thermal exchange devices to or from the cassette and pouch therein through the bay walls;

a temperature control system connected with the thermal exchange devices for controlling the thermal exchange devices independently for independently heating or cooling the cassettes in the bays and the food product disposed therein; and at least one dispensing mechanism associated with the first and second bays for selectively dispensing the food from the pouches that are in the cassettes received in the bays.

2. The food dispenser of claim 1, wherein the bays have a plurality of sides, and the first and second thermal exchange devices extend on the two largest opposite sides of the bays for heating or cooling corresponding opposite sides of the cassettes and pouches therein.

3. The food dispenser of claim 2, wherein the opposite sides have two perpendicular dimensions that are each at least twice as large as the spacing between the opposite sides.

4. The food dispenser of claim 3, wherein said opposite sides are disposed substantially upright.

5. The food dispenser of claim 2, wherein each thermal exchange device additionally extends on a connecting one of the sides of the respective bay to operably connect the portions of the thermal exchange device on said opposite sides.

6. The food dispenser of claim 5, wherein each of the thermal exchange devices has a U-shaped cross-section about the respective bay.

7. The food dispenser of claim 6, wherein each thermal exchange device comprises electric heating elements extending along said opposite sides and have a connecting portion extending on the connecting side of the bay to electrically connect the heating elements.

8. The food dispenser of claim 1, further comprising a third thermal exchange unit configured for circulating a fluid for heating or cooling the dispensing system and also at least one of the bays on one or more sides of the bay other than said opposite sides.

9. The food dispenser of claim 8, wherein the fluid is air, the third thermal exchange device comprises a blower, the blower and housing being configured for directing the air to the dispensing system and about said one or more sides of the at least one bays about the cassette for heating or cooling the dispensing system and pouch in the cassette and the food product therein.

10. The food dispenser of claim 9, wherein the dispenser is configured for circulating the air around the bays about an axis extending through opposite sides.

11. The food dispenser of claim 8, wherein the cassettes define one or more openings configured for allowing the air to be circulated through the interior of the cassettes.

12. The food dispenser of claim 1, further comprising a temperature sensing member associated with at least one of the bays and configured for sensing the temperature of the pouch within the cassette received in the at least one bay, wherein at least one of the cassettes defines a temperature sensing opening configured for receiving the temperature sensing member therethrough to contact the pouch therein, the temperature control system being associated with the temperature sensing member for operating at least one of the thermal exchange devices depending on the sensed temperature.

13. The food dispenser of claim 12, wherein the temperature sensing member comprises a thermistor.

14. The food dispenser of claim 1, wherein the bays are disposed side by side, and the food dispenser further comprises temperature limit units disposed between the bays and associated with thermal exchange device for sensing a temperature beyond a predetermined limit and causing the thermal exchange device to remain within said limit.

15. The food dispenser of claim 14, wherein the temperature limit units comprise a thermistor and another temperature sensitive element that are configured for independently deactivating the thermal exchange devices when the temperature is beyond said limit.

16. The food dispenser of claim 15, wherein the temperature limit units comprise a plate that is removably receivable between the bays in said association with the thermal exchange units, wherein the thermistor and said another temperature sensitive element are mounted to the plate.

17. A flowable food dispenser for dispensing a flowable food product, comprising:

first and second bays each configured for receiving a pouch that contains the food product and has a discharge tube for discharging the food product; and first and second peristaltic pumps disposed adjacent the first and second bays, respectively, for receiving the discharge tubes extending therefrom, each of the peristaltic pumps comprising:

a motor-driven rotor, and a stator having a pumping position relative to the rotor for compressing the discharge tube therebetween and peristaltically pumping the food product within the discharge tube upon rotation of the rotor;

wherein the stators of the fist and second pumps are movable to first and second loading positions, respectively, in which the stators are spaced from the respective rotor sufficiently to load and remove the discharge tube from therebetween; and wherein the loading positions overlap with each other, such that only one of the stators can occupy the first or second loading position at a time.

18. The food dispenser of claim 17 wherein the loading positions are disposed for substantially minimizing the width of the dispenser.

19. The food dispenser of claim 17, wherein the first loading position is displaced diagonally from the pumping position with respect to the horizontal.

20. The food dispenser of claim 19, wherein the first loading position is displaced from the pumping position at a displacement angle of between 10° and 80° with respect to the horizontal.

21. The food dispenser of claim 20, wherein each stator defines a curved compression race configured for receiving and compressing the discharge tube against the rotating rotor, the race having an input end and an output end, and the rotor being operated for pumping the food product from the input end to the output end, and in at least one of the loading and pumping positions a line extending between the input and output ends of the stator is disposed diagonally with respect to the vertical at an angle less than the displacement angle.

22. The food dispenser of claim 17, wherein the bays are configured for receiving a cassette that contains the pouch, the food dispenser further comprising a thermal exchange device associated with the bays for heating or cooling the food within the cassettes received in the bays.

23. A flowable food dispenser for dispensing a flowable food product, comprising:

at least two bays each configured for receiving a pouch that contains the food product and has a discharge tube for discharging the food product; and a peristaltic pump disposed adjacent the bays for receiving the discharge tube extending from one of the bays, the peristaltic pumps comprising:

a driven rotor, and a stator having a pumping position relative to the rotor for compressing the discharge tube therebetween and peristaltically pumping the food product with the discharge tube upon rotation of the rotor, the stator defining a curved compression race configured for receiving and compressing the discharge tube against the rotating rotor, the race having an input end and an output end, and the rotor being operated for pumping the food product from the input end to the output end;

wherein the stator is movable to a loading position in which the stator is spaced from the respective rotor sufficiently to load and remove the discharge tube from therebetween, and in at least one of the loading and pumping positions a line extending between the input and output ends of the stator is disposed diagonally with respect to the vertical.

24. The food dispenser of claim 23, wherein said line is disposed diagonally with respect to the vertical in both the pumping and loading positions.

25. The food dispenser of claim 24, wherein the stator is movable in a direction diagonal to the horizontal between the pumping and loading positions.

26. The food dispenser of claim 25, wherein the orientation of the stator in the loading and pumping positions is selected for substantially minimizing the horizontal width of the pump and of the combined width of the bays, which are disposed above the pump.

27. The food dispenser of claim 23, wherein the diagonally disposed line is at an angle of between 10° and 80° with respect to the vertical.

28. The food dispenser of claim of claim 23, wherein the bays are configured such that at least first and second cassettes containing the pouches are interchangeable between the bays, and the pump is disposed for pumping the food product from one of the bays and not the other such that said other bay is a temperature setting bay for heating or cooling the food product in the cassette therein, the cassette in the temperature setting bay being transferable to said one bay for association with the pump for dispensing the food product therefrom.

29. A flowable food dispenser for dispensing flowable food product, comprising:

a housing having first and second bays configured for receiving a pouch that contains the food product;

at least one dispensing mechanism associated with the first and second bays for selectively dispensing the food from first and second discharge tubes from each pouch received in the first and second bays, respectively; and a dispensing guide disposed with respect to the dispensing mechanisms for aiming an exit opening of the discharge tubes, wherein the dispensing guide is reconfigurable for directing the food dispensed to locations at an adjustable distance from each other.

30. The food dispenser of claim 29, wherein the dispensing guide is reconfigurable for selectively aiming the discharge tubes to direct the dispensed food therefrom to different location or to the substantially same location.

31. The food dispenser of claim 30, further comprising a plurality of dispensing controls activatable by the user to selectively activate the dispensing mechanism to dispense the food from the discharge tubes independently or jointly.

32. The food dispenser of claim 31, wherein the dispensing guide is configured for switching the controls and dispensing mechanism between an independent mode in which the controls activate the dispensing mechanism for dispensing the food from each bay independently, and a joint mode in which the controls activate the dispensing mechanism to dispense the food from both bays together depending on the configuration adjustment of the dispensing guide.

33. A flowable food dispenser for dispensing flowable food product, comprising:

a housing having first and second bays;

a plurality of cassettes removably receivable within the bays, each cassette configured for receiving a pouch containing the food product;

first and second thermal exchange devices associated with the first and second bays, respectively, in heat-exchanging association with the cassettes received therein, wherein the bays have a plurality of sides, and the first and second thermal exchange devices extend on the two largest opposite sides of the bays for heating or cooling corresponding opposite sides of the cassettes and pouches therein;

a temperature control system connected with the thermal exchange devices for controlling the thermal exchange devices independently for independently heating or cooling the cassettes in the bays and the food product disposed therein; and at least one dispensing mechanism associated with the first and second bays for selectively dispensing the food from the pouches that are in the cassettes received in the bays.

34. A flowable food dispenser for dispensing flowable food product, comprising:

a housing having first and second bays;

a plurality of cassettes removably receivable within the bays, each cassette configured for receiving a pouch containing the food product;

first and second thermal exchange devices associated with the first and second bays, respectively, in heat-exchanging association with the cassettes received therein;

a temperature control system connected with the thermal exchange devices for controlling the thermal exchange devices independently for independently heating or cooling the cassettes in the bays and the food product disposed therein;

at least one dispensing mechanism associated with the first and second bays for selectively dispensing the food from the pouches that are in the cassettes received in the bays; and a third thermal exchange unit configured for circulating a fluid for heating or cooling the dispensing system and also at least one of the bays on one or more sides of the bay other than said opposite sides.

35. A flowable food dispenser for dispensing flowable food product, comprising:

a housing having first and second bays;

a plurality of cassettes removably receivable within the bays, each cassette configured for receiving a pouch containing the food product;

first and second thermal exchange devices associated with the first and second bays, respectively, in heat-exchanging association with the cassettes received therein;

a temperature control system connected with the thermal exchange devices for controlling the thermal exchange devices independently for independently heating or cooling the cassettes in the bays and the food product disposed therein;

at least one dispensing mechanism associated with the first and second bays for selectively dispensing the food from the pouches that are in the cassettes received in the bays; and a temperature sensing member associated with at least one of the bays and configured for sensing the temperature of the pouch within the cassette received in the at least one bay, wherein at least one of the cassettes defines a temperature sensing opening configured for receiving the temperature sensing member therethrough to contact the pouch therein, the temperature control system being associated with the temperature sensing member for operating at least one of the thermal exchange devices depending on the sensed temperature.

* * * * *